US008087335B2

(12) United States Patent
Shekarri

(10) Patent No.: US 8,087,335 B2
(45) Date of Patent: Jan. 3, 2012

(54) SYSTEMS AND METHODS FOR REPEATING AREA DENIAL

(75) Inventor: Nache D. Shekarri, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 0 days.

(21) Appl. No.: 12/974,898

(22) Filed: Dec. 21, 2010

(65) Prior Publication Data

US 2011/0090084 A1 Apr. 21, 2011

Related U.S. Application Data

(63) Continuation of application No. 11/868,512, filed on Oct. 7, 2007, now Pat. No. 7,886,648.

(60) Provisional application No. 60/850,057, filed on Oct. 7, 2006.

(51) Int. Cl.
*F41B 15/04* (2006.01)

(52) U.S. Cl. ..... 89/1.11; 89/41.03; 42/1.08; 119/908; 340/573.1; 361/232

(58) Field of Classification Search ..... 42/1.08; 89/1.11, 41.03; 119/220, 721, 908; 340/573.1, 340/573.3; 361/232
See application file for complete search history.

(56) References Cited

U.S. PATENT DOCUMENTS 3,735,703 A 5/1973 Bayer
4,712,479 A 12/1987 Babel
5,345,874 A 9/1994 Lemonnier
5,465,687 A * 11/1995 Custer ..... 119/719
5,936,183 A * 8/1999 McNulty, Sr. ..... 89/1.11
5,955,695 A * 9/1999 McNulty, Sr. ..... 89/1.11
5,956,424 A * 9/1999 Wootton et al. ..... 382/192
6,064,308 A * 5/2000 Janning et al. ..... 340/573.3
6,166,643 A * 12/2000 Janning et al. ..... 340/573.3
6,269,726 B1 * 8/2001 McNulty, Sr. ..... 89/1.11
7,057,872 B2 * 6/2006 Smith et al. ..... 361/232
7,210,392 B2 * 5/2007 Greene et al. ..... 89/41.03
7,280,340 B2 * 10/2007 Smith et al. ..... 361/232
7,602,597 B2 * 10/2009 Smith et al. ..... 361/232
7,701,692 B2 * 4/2010 Smith et al. ..... 361/232
7,886,648 B2 * 2/2011 Williams et al. ..... 89/1.11
2003/0051597 A1 3/2003 O'Dwyer
2005/0207622 A1 * 9/2005 Haupt et al. ..... 382/118
2009/0020002 A1 * 1/2009 Williams et al. ..... 89/41.03
2009/0316326 A1 12/2009 Chiles

FOREIGN PATENT DOCUMENTS

EP 0960048 2/2004

* cited by examiner

*Primary Examiner* — Michael David
(74) *Attorney, Agent, or Firm* — William R. Bachand

(57) ABSTRACT

Systems and methods inhibit locomotion of a human or animal target in a denial zone. Acquiring the target includes forming a prediction of at least two locations of impact on the target and testing the prediction according to criteria that may include whether the locations are within a boundary corresponding to the target and whether the locations are separated by a minimum physical and/or electrical distance. The two locations may serve for conducting a current through the target for impeding locomotion by the target. The current may be repeated in response to determining that locomotion was not sufficiently impeded. Determination may depend on analysis of video of the target.

12 Claims, 12 Drawing Sheets

| | STIMULUS SIGNAL | | | | |
|---|---|---|---|---|---|
| DESCRIPTION | PATH MANAGEMENT | | TARGET MANAGEMENT | | |
| STAGE | PATH FORMATION | PATH TESTING | STRIKE | HOLD | REST |
| SHAPE | A | A | A B | A B | |
| DURATION | 10-100 μSEC | 10 μSEC | 50 μSEC | 50 μSEC | 2 SEC |
| AMPLITUDE | A = 50KV POWER = 0.75-3.0 JOULES | A = 450 V | A = SPV B@100 μC | A = SPV B@100 μC | 0 |
| REPETITION RATE | N/A | 1 TO 3 PULSES/MIN. | 20/SEC | 10/SEC | 0 |
| TYPICAL DURATION OF STAGE | 0.0005 SEC | 0.001 SEC | 2 SEC | 28 SEC | 2 SEC |

*FIG. 12*

SYSTEMS AND METHODS FOR REPEATING AREA DENIAL

CROSS-REFERENCE TO RELATED APPLICATION

This application is a continuation of and claims priority under 35 USC §120 of U.S. patent application Ser. No. 11/868,512 to Kevin Williams, et al., filed Oct. 7, 2007 U.S. Pat. No. 7,886,648 and claims the benefit under 35 U.S.C. §119(e) of U.S. Patent application Ser. No. 60/850,057 to Kevin Williams, et al., filed Oct. 7, 2006.

FIELD OF THE INVENTION

Embodiments of the present invention relate to systems for area denial and methods performed by systems for area denial.

BACKGROUND OF THE INVENTION

Conventional area denial technology has been applied, for example, in military settings to deny personnel and vehicles from passing across a particular surface area called a denial zone. Passage of a target into the denial zone is detected by object proximity technologies including trip wires, acoustic sensors, compression plate sensors, and laser beam occlusion sensors. Denial may be accomplished by lethal force such as used in antipersonnel land mines, antivehicle land mines, and projectiles intended to strike the target. In some systems, denial may be automatic upon detecting a disturbance in the denial zone.

Conventional area denial fails or is considered unsuccessful when a suitable target passes through the denial zone. Failure may be due to ineffective deployment of force to stop the intrusion or due to insensitivity. Force may be ineffective when deployed with insufficient accuracy. In addition, conventional area denial systems generally suffer from a high incidence of false alarms.

A false alarm is an event where force is deployed but no suitable target is available to effect meaningful denial. The target may not be a suitable target, for example, where an area denial system is planned against human intruders but responds inappropriately to animals, wind blown foliage, or changes in surface illumination. The target may be unavailable because it is not actually in the denial zone, or is in the zone but is out of range of denial forces (e.g., in a dead portion of the denial zone).

Insensitivity occurs when a suitable target is available in the denial zone without an appropriate response by the area denial system. Insensitivity may occur when the target goes undetected, is misclassified as an unsuitable target, or is erroneously determined to be unavailable (e.g., cannot be acquired by targeting technology).

Some conventional area denial systems provide notice to an operator before deploying force intended to stop a target. These systems are called man-in-the-loop systems. The operator may issue a command to abort automatic deployment of force, authorize deployment of force, or may muster other resources to respond to the threat indicated by the system. These systems are generally expensive because it is difficult to staff alert human operators. These systems are subject to failure to actually accomplish area denial for example due to operator insensitivity.

Conventional area denial systems include antipersonnel land mines that deploy nonlethal force such as electronic control devices as taught by U.S. Pat. No. 5,936,183 to McNulty. In such systems, automatic deployment follows disturbance detection. Notice is provided to system operators for mustering resources to respond to the breach of security that the area denial deployment implies to have occurred. In such systems, after detecting a disturbance, all nonlethal resources are deployed in a small set of directions into the denial zone. There remains a significant probability of unsuccessfully denying passage of a suitable target through the zone. Further, the force taught by McNulty is known to be insufficient to halt locomotion by a human or animal target. An apparatus for inhibiting locomotion of a target disclosed herein may be of the type sufficient to halt locomotion.

In nonmilitary settings, monitoring technologies have been used for data collection, and for providing increased safety or security for persons and property. These systems are capable of denying access (e.g., denying opening a door to a nonemployee) but are not capable of deploying force to deny movement through a denial zone.

Area denial technology and monitoring technology as discussed above include disturbance detection (e.g., sensor networks), surveillance (e.g., video signal detection, processing, transmission), target classification (e.g., video signal analysis), transmission of notice of an intrusion event (e.g., radio contact to dispatch soldiers, telephone contact to local police), and display of information (e.g., processed video from surveillance, notice to an operator). These technologies are not sufficient to meet significant demand for high safety and high security installations.

New applications for area denial cannot be met with conventional area denial technologies. For example, if conventional area denial technology was to be used in a prison, or near a utility substation having dangerous equipment, lethal force would be unwarranted; and mere notice of intrusion may be insufficient to accomplish the intended safety and/or security purposes. Conventional nonlethal area denial systems are inaccurate and subject to high incidence of false alarms and insensitivity. Without the present invention, area denial systems cannot meet user requirements for a high level of safety and/or security.

SUMMARY OF THE INVENTION

An apparatus, according to various aspects of the present invention acquires a human or animal target for area denial. The apparatus includes a processing subsystem and a launch subsystem. The processing subsystem, in accordance with indicia of the target, forms a prediction comprising at least two locations, each location for impact on the target of an electrode of a plurality of electrodes and a probable distance between the locations. The launch subsystem controls deployment of the plurality of electrodes, wherein control is responsive to testing whether the prediction meets at least one criterion for a successful area denial due to a current through the target and between at least two electrodes of the plurality of electrodes.

A method for area denial, according to various aspects of the present invention, is performed by an apparatus that inhibits locomotion in or through an area by a human or animal target using a current between electrodes. An apparatus performs the method. The method includes, in any practical order: (1) forming a prediction comprising at least two locations, each location for impact on the target of an electrode of the plurality and a probable distance between the locations; (2) testing whether the prediction meets at least one criterion for successful area denial due to the current; and (3) providing a signal for launching at least one electrode of the plurality in response to testing.

BRIEF DESCRIPTION OF THE DRAWING

Embodiments of the present invention will now be further described with reference to the drawing, wherein like designations denote like elements, and:

FIG. 12 is a timing diagram for various stimulus signal stages provided by the immobilization device of FIG. 11;

DETAILED DESCRIPTION OF THE PREFERRED EMBODIMENTS

Figure 1:
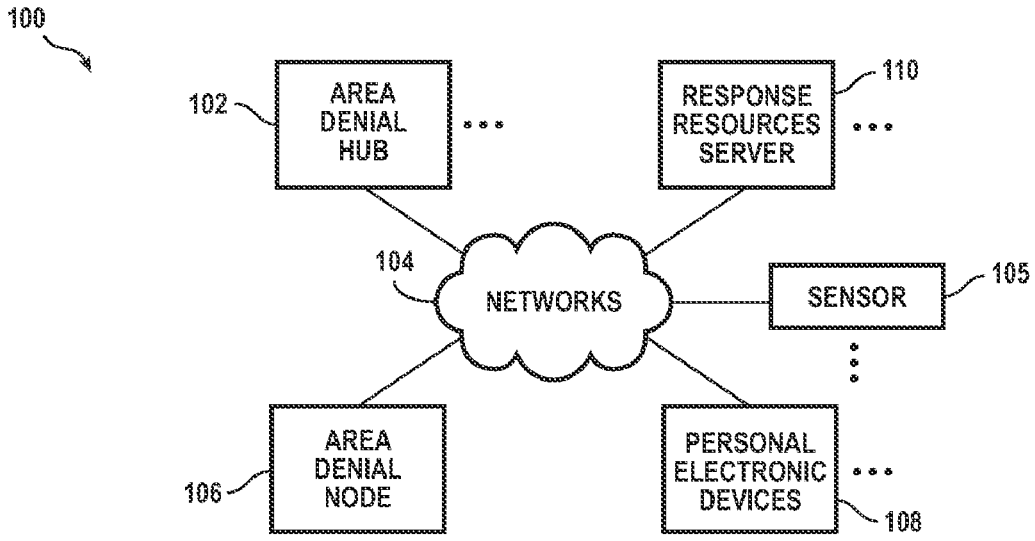
FIG. 1 is a functional block diagram of a system according to various aspects of the present invention.

An area denial system, according to various aspects of the present invention, inhibits locomotion of a human of animal target with respect to a zone. Successful area denial may be complete as to a target; or, incomplete yet sufficient as to a target Inhibiting includes deterring further voluntary movement with respect to the zone Inhibiting includes pain compliance (e.g. sufficiently interfering with locomotion) and/or immobilization (e.g., halting locomotion). Force used to inhibit may be applied to cause pain and/or to immobilize Immobilization may include electrically disrupting the target's voluntary control of its skeletal muscles. An amount of force applied may be determined with respect to a classification of the target (e.g., kind of animal, human, size), present location of the target (e.g., more force at locations deeper within the zone), and/or velocity and direction of movement of the target. In a simpler implementation, the same force may be used against all classes, locations, and vectors of targets.

In the system examples discussed below, force for inhibiting locomotion may include launching toward the target materials (e.g., markers, paper balls, rubber bullets) and/or electrodes (e.g., tethered or wireless). According to various aspects of the present invention, effectiveness of launching is improved for launches that involve more than one point of impact on the target. For instance, at least two points are generally used for effectively inhibiting locomotion using electronic current (e.g., stun guns, weapons that launch wire-tethered electrodes, electrified projectiles with wireless electrodes). Therefore, for clarity of presentation systems of the type that conduct a current through at least two electrodes at the target are discussed for illustrating the invention. The two points of impact may involve two wire-tethered electrodes, an electrified projectile that deploys at least two electrodes, or a combination of wire-tethered and wireless electrodes. Electrodes are considered wireless when the circuit for passing a current through the target does not include tether wires from the launch subsystem to the target.

An area denial system, according to various aspects of the present invention, acquires a target. Target acquisition may include determining a specific plan for taking action against a particular target. As a result of target acquisition, a choice may be presented to an operator to decide whether or not to proceed with the plan. When preauthorization to take action has been made by an operator, an area denial system may take action as soon as a target is acquired. For example, an area denial system may take action by launching electrodes toward any target it acquires.

Acquiring a target for launching objects (e.g., materials, electrodes, projectiles) may include determining the direction and timing of launching with respect to target location, direction of movement, and expected path of continued movement.

An area denial system, according to various aspects of the present invention, takes a warning action and/or deploys a force against a target to inhibit locomotion of a target with respect to an area. An area denial system may take a warning action (e.g., scare, confuse, verbal warning) that deters a target from entering an area or persuades the target to voluntarily change course and/or leave an area.

A warning action may include making a loud noise (e.g., siren, alarm, bell), producing an audible and/or visible electric arc, detonating of a flash-bang munition, and issuing an audible verbal warning. An area denial system may determine the type of warning action in accordance with a policy. A human operator may specify the type of warning action.

An area denial system may take action to deploy a force against a target. A force deployed by an area denial system may be such as to have lethal effect to a high probability. Such force is herein called lethal force, for simplicity, realizing that unsuccessful deployments may be non-lethal. A force deployed by an area denial system may be such as to have a non-lethal effect to a high probability. Such force is herein called non-lethal force, for simplicity, realizing that improbable deployments may be lethal.

A lethal force may permanently halt target locomotion through an area. A non-lethal force may temporarily halt locomotion of the target so that conventional methods may be used to arrest the target (e.g., a guard affixing shackles and/or handcuffs to the target).

Functional goals of an area denial system, according to various aspects of the present invention, include adversely affecting every instance of a desired type of target that intrudes an area designated as a denial zone so that the target does not proceed through the area, inhibiting (e.g., halting) locomotion sufficiently for the arrest of every instance of a desired type of target that intrudes the denial zone, exhibiting a high degree of accuracy in deployment of non-lethal force, exhibits a high probability of effective deployment of force, exhibiting a low probability of false alarm, and exhibiting a low probability of insensitivity to the desired type of target. Systems and methods of the present invention provide superior performance to prior art systems by accomplishing a combination of these functional goals.

Passing a current through a human or animal target may cause pain and/or halt locomotion. Preferably, the current through a target halts locomotion by overwhelming voluntary control of target skeletal muscles by the target. Various examples of currents that accomplish halting of locomotion, circuits that produce such currents, and methods of producing such currents are described in the various subsystem descriptions herein. Systems and methods according to the present invention may include any of the described currents, circuits, and methods of producing such currents.

A circuit may be formed to provide a current through a target. The circuit may include a signal generator that provides the current. An area denial system detects and makes a target a part of a circuit for delivery of the current. The target may become a part of a circuit voluntarily and/or involuntarily.

A target may voluntarily come into contact with such a circuit by moving into contact with terminals (e.g., walking onto a mesh of terminals, grasping one or more terminals to traverse an obstacle, falling against terminals).

A target may involuntarily come into contact with such a circuit by moving proximate to terminals that produce an electric arc through the air to establish a circuit with the target (e.g., a local stun function). An area denial system may propel electrodes toward a target for impact with the target to establish the circuit to deliver the current (e.g., remote stun). The electrodes may be wire-tethered to a launch device; or (e.g., wireless) coupled to a projectile that may be launched toward a target without a wire-tether to the launch device.

Wire-tethered electrodes may separate upon launch and fly diverging paths toward the target. A distance between a launch device and a target may determines electrode spacing upon impact with the target or reaching a maximum length of the wire tether (e.g., 15 to 35 feet at 5 to 10 meters from target). An electrified projectile may include a power source, a signal generator, and electrodes for a remote stun function.

For example, area denial system 100 of FIGS. 1-16, according to various aspects of the present invention, denies passage through an area by deploying non-lethal force that halts locomotion of desired targets. System 100 may include zero or more area denial hubs 102, zero or more response resources servers 110, zero or more networks 104, zero or more sensors 105, one or more area denial nodes 106, and zero or more personal electronic devices 108.

A network couples components via links for communication. A network may permit any component of a system to communicate with any other component of the system. For example networks 104 include any conventional hardware (e.g., wired, wireless) and software (e.g., SMTP, TCP/IP) to perform communication among similar or dissimilar components (e.g., any area denial hub 102, any sensor 105, any area denial node 106, any personal electronic device 108, and any response resources server 110). Any conventional protocols may be used (e.g., URLs of the Internet, MAC addresses of a cellular telephone system). Networks 104 may include one physical form and protocol stack or may comprise multiple physical forms and various protocol stacks joined, for example, by conventional bridge technology.

Figure 2:
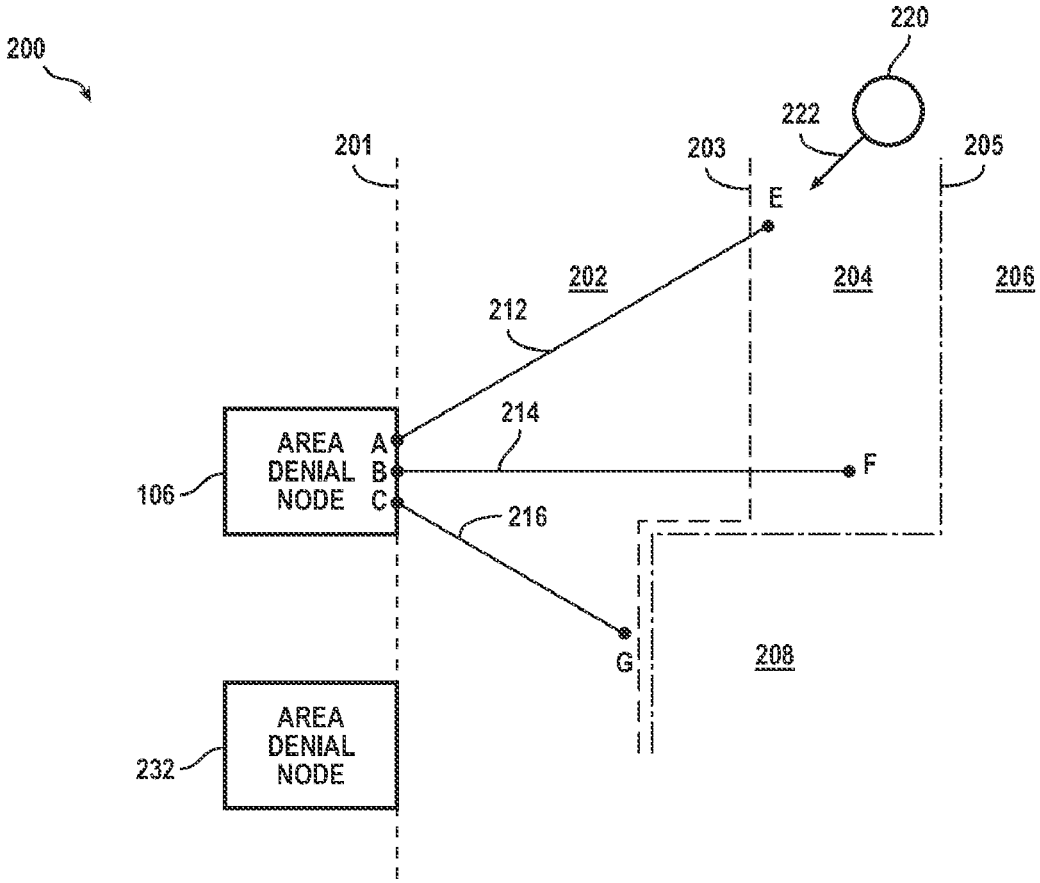
FIG. 2 is a plan view of an area that includes a denial zone protected by the system of FIG. 1.

Any one component of system 100 may broadcast data to any number of other components. For example, any area denial node may send target data (e.g., classification, description, position, motion vector, result of a prior deployment of force) or surveillance data (video, audio) to any number of other area denial nodes. An area denial hub may broadcast data to all area denial nodes. An area denial node may communicate with any other component to facilitate cooperative action. For example, in FIG. 2, area denial node 106 may request that area denial node 232 illuminate a target located at position "G".

System 100 may comprise any conventional ad hoc network (e.g., of the type described by U.S. Pat. No. 6,775,258 to vanValkenburg and its references). Mobile components capable of communication may request, upon arriving within communication range, access to the network. A mobile component may select or be assigned a channel and/or link for communication and support of ad hoc network functions. A network may report to other components of system 100 when a component becomes available or unavailable.

A sensor detects physical quantities, physical characteristics, and/or a change in a physical quantity or characteristic. A sensor may detect indicia of a target. Sensors in system 100 may perform an early warning function. Sensors may provide surveillance data for analysis by an area denial node.

A sensor may include any conventional sensing equipment and software. For example, sensors 105 may include cameras (e.g., still, video, infrared, visible light, ultraviolet), acoustic monitors (e.g., for detecting vehicular or pedestrian activity), trip wires (e.g., filament, light beam, radio, radar, sonar, video detection and comparison), location detectors (e.g., GPS receivers) that may be physically associated with a boundary of an area (e.g., a buoy, stake, fence, vehicle, obstruction) or the location of a person (e.g., target being snooped, operator of a hub (e.g., for determining alertness and whereabouts)), and motion detectors (e.g., field of view differencing detectors, illumination change detectors, change of reflectivity detectors).

Sensing may include surveillance. Surveillance may include video signal detection, processing, and transmission. A sensor may provide surveillance at a boundary of a no-action zone, within a denial zone, or over an area to be occupied by operators (e.g., to reduce insensitivity due to inattention of operators).

A sensor may detect an event. A sensor may report an event. Events may include greater than a threshold amount or duration of motion (e.g., by branches, people, or animals), intrusion by a possible target, whether or not a component is operational, changes of operating status of components (e.g., an area denial node is knocked out of position or out of service by an attack (e.g., a rock thrown) by a target), and status of a target (e.g., immobilized, exited from an area).

Surveillance data and/or indicia of a target may include video (e.g., one or more images), audio (e.g., voice, silent dog whistle, foot steps, vehicle noise), electromagnetic radiation (e.g., flashlight beam, cell phone transmissions, radio transmissions, body heat), and mechanical (e.g., vibration) indicia. In one implementation, sensors 105 include a video camera for taking successive images of an area that may include a target. In another implementation, sensors 105 include a motion and/or vibration sensor for detecting movement. Detection of indicia of a target may be accomplished by analysis of the data provided by the video camera, motion sensor, and/or vibration sensor.

Any sensors 105 may be integral with an area denial node 106.

A system for early warning may include a sensor that alerts a hub (e.g., so that the hub may alert particular area denial nodes) or alerts an area denial node (e.g., for commencing target surveillance).

An area denial hub may include a manned station that receives status of system components, notices of alerts and events, and may receive requests to proceed with deployments. An area denial hub 102 may receive data (e.g., video, audio, motion, heat) from one or more sensors 105, area denial nodes 106, and/or personal electronic devices 108. A hub may be physically located near to or distant from a protected area.

A hub may include a user interface for display of conventional presentations including selected and summarized status, videos, panoramas, zooms, full duplex audio feeds, and results of data analysis. An operator of the hub, in response to status changes and/or alerts, may cause selected components of system 100 to become operational (e.g., leave a standby state). In response to a request to take a warning action or to deploy a force, an operator may authorize a warning action or deployment of a force by one or more area denial devices or personal electronic devices. The authorization may be processed automatically by an area denial node or provide an audible or visual cue for an operator of a personal electronic device.

A user interface may display a result of analysis performed by an area denial node. For example, the user interface may receive and display a prediction of at least two locations of electrode impact on a target, a result of testing a prediction with a criterion for a successful immobilization, a criterion used to test for a successful immobilization, indicia of a target, a distance to a target, and/or a motion vector of the target.

An operator may also provide data via the user interface for use by an area denial node for forming predictions (e.g., electrode spread per distance traveled, location of electrode impact on target), testing for a successful immobilization (e.g., threshold distance between electrodes), target description and classification (e.g., type of target), and policies used for autonomous operation of an area denial node (e.g., types of targets to exclude, escalation from a warning action to deployment of force).

A response resources server is a network component for increased security of the area being protected. Response resources server 110 may be a manned station associated with backup security and/or medical capability. Backup security capability for commercial or personal area denial may include local law enforcement. Backup security capability for military area denial may include a command and control logistics system and/or a manned center.

A personal electronic device may be attached to or carried by a person (e.g., user, operator, target). Attaching may be accomplished by conventional covert methods. Personal electronic device 108 may describe its user to system 100. A personal electronic device may support communication between the user of the personal electronic device and an operator (e.g., area denial hub) or other component of system 100 (e.g., an area denial node). A communication may include an identity of the personal device user (e.g., badge number, name of a security officer, military force, rank), location of the personal device user (e.g., GPS location), type of personal electronic device (e.g., make, model, serial number, network address, issuing authority), and capabilities of the personal electronic device (e.g., cell phone with camera, electronic weapon, lethal weapon, audio recorder, or lighting capability).

In operation, a personal electronic device 108 may identify a user who may travel through an area identified as a denial zone without being identified as a target. When a personal electronic device is associated with a vehicle or other physical entity, the vehicle or entity may occupy or travel through an area without being identified as a target. In one implementation, personal electronic device 108 includes an electronic weapon (e.g., a hand held launch device of the type marketed by TASER International as model M26, X26, C2, or a shotgun with model XREP rounds) that may have sensors (e.g., video and or audio) and status (e.g., deployment capabilities, deployment history) that may be used as a basis for planning and/or authorizing deployments by any node of system 100. In another implementation, a personal electronic device 108 includes a conventional burglar alarm system for detection of intruders and notification of security (e.g., telephone to local police).

An area denial node protects an area from intrusion by targets. Protecting an area may include any combination of some or all of performing surveillance, detecting targets, identifying targets, classifying targets, issuing warnings to deter targets from a protected area, communicating with a target to persuade a target to exit a protected area, deploying a force, and/or inhibiting locomotion of a target. An area denial node 106 may cooperate with other components of area denial system 100, including other area denial nodes, to identify, classify, deter, persuade, deploy, and/or inhibit locomotion. An area denial node may perform surveillance of an area, receive data from sensors, detect indicia of a target, analyze indicia of a target, describe a target, classify a target, adjust target information in accordance with a prior deployment of a force, apply a policy to determine a response to classes of targets, and/or apply a policy to determine whether to take a warning action to deter the target or to deploy a force to inhibit locomotion of the target. A policy may permit autonomous action by the area denial node or require human operator intervention.

An area denial node 106 uses sensors to acquire data from an area. The area denial node analyzes the data to detect indicia of a target. Methods of analysis to detect indicia of a target may include, inter alia, detecting changes, movement, heat, or electromagnetic radiation; forming a description of a target (e.g., size, travel vector, speed); and/or classifying a target (e.g., human, animal, vehicle, friend, foe).

An area denial node 106 may cooperate with a sensor (e.g., sensors 105, part of node 106, part of another node 106, part of a personal electronic device 108) to acquire surveillance data (e.g., notice of motion in a zone of interest to the node, whether or not that zone is part of its denial zone; target type, travel vector), deployment data, target response to immobilization attempts (e.g., successful, unsuccessful), planned deployments, and notice to "wake-up" (e.g., turn on a function that was dormant for power economy). For example, in response to notice that the sensor is available, an area denial node may request (or subscribe) to notices, data, and/or video from any sensor.

An area denial node may operate autonomously as the only component in an implementation of system 100. Several area denial devices may cooperate with a network to protect separate and/or overlapping areas.

In one implementation, area denial node 106 uses data provided by sensors 105 for monitoring, surveillance and/or acquiring targets in an area. In another implementation, sensors 105 provide notice of a change in a protected area to put one or more area denial nodes 106 into an active state (e.g., full power, operational) to use sensors that are part of area denial node 106.

An area denial node may cooperate with an area denial hub. For example, an area denial node 106 may provide to an area denial hub 102 operational status, deployment capabilities (e.g., remaining available deployments), target descriptions, target classifications, results of target analysis, results of a prior deployment, deployment plans, requests for authorization to deploy a force according to a particular plan, and/or requests for authorizations to deploy according to a policy or to any of a set of plans (e.g., node takes on more autonomy). A hub 102 may respond to a node 106 by providing operational status of the hub, availability of response resources 110 (e.g., as may affect performing to a policy by the node), availability of sensors 105, sensor data (e.g., may be analyzed by the hub prior to distribution), notices (e.g., of attempts to link to the network, personal electronic devices 108, or other nodes 106), communication channel assignments, time synchronization, and/or updates to software (including policies) for use by the node. Distributed image analysis as discussed below is another example of cooperation between area denial nodes and/or area denial hubs.

An area denial node 106 may cooperate with a response resources server 110 by providing notice of events, plans for deployment, history of deployments, and/or identification and location of personal electronic devices 108. The response resources server 110 may collect reports sent by an area denial node 106 including reported intrusions (time of day, date, target type, resolution), planned deployments, and/or use of force reports.

An area denial hub 106 may cooperate with a sensor 105 to request relocation/redirection of the sensor, to obtain data from the sensor, and/or to enable/disable particular sensors 105.

An area denial node 106 may cooperate with a personal electronic device 108. A personal electronic device 108 may deploy a force. The personal electronic device may include any sensor discussed herein. The area denial node may plan, authorize a deployment, and/or inhibit authorization of a deployment of a force by the personal electronic device (e.g., so as not to deploy more force against a target than established by a policy).

An area denial node may cooperate with any other area denial node. An area denial node may acquire from any other area denial node in system 100 surveillance data and/or target indicia (e.g., notice of motion, target type, travel vector, target location, target description, target area, target boundary), notice of provision of a current through the target, deployment data (e.g., frequency, total deployments), launch capabilities (e.g., range, number of remaining deployments), target response to a deployment of force (e.g., successful immobilization, unsuccessful immobilization), planned deployments, deployment authorization, test criteria, and/or adjustments to test criteria.

Operation of an area denial node may be better understood with reference to a plan view of an exemplary installation. For example, installation 200 of FIG. 2 includes area denial node 106 located adjacent to denial zone 202 defined from boundary 201 to boundary 203. Installation 200 includes warning zone 204, no-action zone 206, and a no-action region 208 of no-action zone 206. For ease of description, installation 200 is shown in plan view in a horizontal plane corresponding to the surface of the earth. Installation 200 may further include a volume immediately above the surface; in such case boundaries are more than lines as shown and extend as surfaces into the volume. The shape of the zones may be arbitrary as desired to protect persons or property with suitably arranged area denial nodes, sensor ranges, deployment trajectories, and allowances for obstructions to sensors and/or deployment trajectories. The zones shown in installation 200 are defined with respect to area denial node 106. Installation 200 includes area denial node 232 having zones overlapping or adjacent to zones of area denial node 106. Zones and deployment trajectories with respect to node 232 are omitted from FIG. 2 for clarity of presentation.

A denial zone generally includes the trajectories of all possible deployments from an area denial node. For example, denial zone 202 extends between boundary 201 and boundary 203. Generally, a denial zone is fully within the working range of sensors (e.g., video cameras, thermal sensors, vibration detectors) of sensors 105 and/or sensors of an area denial node. Further, a denial zone is generally fully within at least one trajectory of a deployment from at least one area denial node 106. A trajectory may extend into a warning zone. That portion of a trajectory that extends into a warning zone may have insufficient accuracy or reliability for normal operation.

A warning zone lies beyond the denial zone. The working range of sensors that cover the denial zone may extend into the warning zone or a portion of sensors may operate solely in the warning zone. For example, warning zone 204 extends between boundary 203 and boundary 205. Target surveillance and analysis (e.g., video, audio, motion, infrared, vibration) is generally underway when a target is in a warning zone. An area denial node 106 may issue an audible or visible warning, verbally command a target (e.g., "do not enter" assuming the disturbance is an English speaking human), inform the target of consequences for entering the denial zone (e.g., "if you proceed further, you will be arrested"), and/or enable further sensors or nodes (e.g., 106 activates 232) to prepare for target analysis.

A warning action may be undertaken as a warning (e.g., launch a flash-bang munition, launch of a flare, display of an electric arc, display of a laser sight spot on the target) to deter the target from entering the denial zone. Authority for taking a warning action may be controlled by a policy autonomously implemented by an area denial node or by a seeking authorization from a human operator. For example, in one implementation, authorization for a deployment is determined automatically by area denial node 106 according to policy 1616.

In an example, depicted in FIG. 2, target 220 is positioned within warning zone 204. Target 220 moves by locomotion (e.g., running, walking, crawling) in a direction indicated by vector 222. Target 220 may also move in a manner not related to locomotion (e.g., talking, gesturing, shaking, falling down). According to various aspects of the present invention, target analysis includes determining whether locomotion has halted. If locomotion has not halted (e.g., ineffective warning or deployment of a force, unsuccessful immobilization), policy may direct a subsequent deployment of the same or different type and may further direct whether authorization is required for a subsequent deployment.

A no-action zone 206 permits economy of node operation. Disturbances detected by sensors are not subject to target analysis until the disturbance moves or is detected inside boundary 205. When a sensor detects a disturbance (e.g., motion of branch 408, movement of man 404, or movement of dog 406), area denial node 106 may enter an active state (e.g., wake-up, operate at full power, become operational).

In one implementation, area denial node 106 is capable of a force deployment on three trajectories 212, 214, and 216, into denial zone 202, illustrated as line segments AE, BF, and CG, respectively. Each trajectory may include a plane or cone that includes the line segment shown (e.g., as a central or sight axis), depending on the type of object propelled along the trajectory. For example, pepper spray may be deployed in a cone or cloud propelled toward a target. Rubber bullets or bean bags may be deployed in a set that occupies a volume having a pattern at any particular plane perpendicular to the trajectory (e.g., perpendicular to an axis AE).

An area denial node may evaluate, according to various aspects of the present invention, a likelihood of a successful deployment of a force for successful area denial (e.g., to inhibit locomotion of a target). A planned deployment of a force may be made in accordance with testing a predicted force pattern. A force pattern that includes predicted locations of impact of at least two projectiles (e.g., wire-tethered electrodes, electrodes of an electrified projectile) on a target may be used to predict the efficacy (e.g., successful, unsuccessful) of inhibiting locomotion due to a current passed through the target and between the electrodes.

Impact on a target, as used herein for simplicity, includes impact on clothing worn by a target or otherwise locating an electrode within an operational distance (e.g., for a practical arc) of the target's tissue.

An area denial node (e.g., 106, of FIG. 3) may include network interfaces 302, other link interfaces 303, processing subsystems 304, disturbance detectors 306, target communication subsystems 308, launch subsystems 310 that operate cartridge(s) 314 and/or projectile(s) 316, surveillance subsystems 320, and sensors 322.

Network interfaces 302 manage hardware and software protocol functions to enable communication by an area denial node 106 and any network 104. Network interfaces for wireless networks may include radio transceivers for sending and receiving messages (e.g., voice, data, pictures via cellular telephone, internet, closed circuit television, broadcast television) in any conventional manner.

Link interfaces 303 manage hardware and software protocol functions to enable a node 106 to communicate with any area denial hub 102, sensor 105, area denial node 106, personal electronic device 108, and/or response resources server 110 that may not have immediate capability or access to networks 104. Link interfaces 303 may communicate via a wired or wireless interface.

Processing subsystems 304 may include any conventional hardware and software for computing (e.g., performing methods automatically, performing mathematical calculations, responding in accordance with a result of a calculation), receiving data, and converting data. Processing subsystems 304 may further include data storage (e.g., circuits, drives), peripherals, user interfaces, protocol stacks, operating systems, particular application software, and configuration control software. User interfaces (not shown) may be used for node maintenance, performance evaluation, and monitoring during operation. Functions performed by a processing subsystem may include inter alia initiating and responding to network communication, monitoring at least one denial zone, monitoring a warning zone, issuing a warning to be made by target communication subsystem 308, analyzing responses received from subsystem 308, initiating and conducting snooping on the target (e.g., planning deployments, analyzing reconnaissance data), cooperating with launch subsystems 310 (e.g., performing launch controls, performing stimulus controls, obtaining status and deployment capabilities, commanding reconfiguration, commanding deployment), cooperating with target surveillance subsystems 320 (e.g., providing video controls, determining target descriptions, determining target classifications, determining target forms, determining target area, determining target boundary, determining force patterns), tactical coordination among launch subsystems, other nodes and personal electronic devices, cooperating with sensors 322, receiving surveillance data and/or target indicia from another area denial node via network interfaces 302, and producing (e.g. publishing to subscribers) use of force reports all of which as discussed above.

Processing subsystems 304 cooperates with other systems to accomplish area denial (e.g., inhibit locomotion of a target). For example, processing subsystems 304 may cooperate with launch subsystems 310 and surveillance subsystems 320. Processing subsystems 304 may receive target data from target surveillance subsystems 320 for, inter alia, forming a prediction of at least two locations for electrode impact with the target, determining a distance between the predicted locations, detecting a boundary of the target, and testing a prediction of the two locations with a least one criterion for a successful immobilization as discussed above.

For example, processing subsystems 304 may analyze sequential video images to detect indicia of a target, target description, target classification, target travel vector, distance to target, and target boundary. Processing subsystems 304 may include microprocessor(s) executing stored program code to predict a force pattern and to test a criterion for facilitating a successful denial.

Processing subsystems 304 may cooperate with launch subsystems 310, surveillance subsystems 320, and target communication subsystems 308 to determine an effectiveness of a prior deployment of force against a target. According to various aspects of the present invention, processing subsystems 304 may make adjustments to improve the effectiveness (or likely effectiveness) of a subsequent action. For example, adjustments may include selecting or changing policies, target classification heuristics, cartridges, projectiles, force patterns, target boundaries, and/or criteria as discussed herein. Processing subsystems 304 may receive target data from target surveillance subsystems 320 to detect whether locomotion of the target has stopped. Processing subsystems 304 may receive data from launch subsystems 310 indicating whether a current has been delivered through the target. Processing subsystems 304 may use information indicating that target locomotion has not halted and/or that no current was provided through the target to adjust, inter alia, subsequent prediction of locations (e.g., decrease or use smaller regions of predicted impact prior to testing) of electrode impact, a threshold distance between two predicted locations, a boundary of the target, and a criterion for a successful immobilization.

Area denial node 106 may cooperate with any other area denial node (e.g., area denial node 232) to obtain and/or provide data for processing subsystems 304 to perform the above analysis and/or adjustments.

Disturbance detectors 306 are sensors of the type of sensors discussed above. A disturbance may be detected without target analysis. Motion of a branch 408 may be a disturbance. Tampering with a node may be a disturbance. Detecting tampering may include detecting vibration, shock, loss of communication capability on a wired link, loss of throughput on a wireless link, loss of power, decrease of a signal from a sensor to below a threshold, or loss of a video signal.

A target communication subsystem 308 may include audio functions as discussed above. Audio may be analyzed to provide indicia of target behavior (e.g., screams indicate probable effective use of force). An operator may communicate with the target by routing operator communications of area denial hub 102 to target communication subsystems 308 of one or more area denial nodes 106. Target communications subsystems 308 may also include video capability to permit the operator to visually monitor a target.

A conventional surveillance bug and/or sensor of any type may be deployed to be affixed to the target or to be located near the target to acquire further information, including audio and/or video data, from the target. Data from a biometric projectile or biometric circuitry cooperating with wire-tethered electrodes may be used by area denial node 106 to enhance safety of targets, other persons, or animals Target communication subsystem 308 provides a "snooping" capability that may be routed to include any node 106, any hub 102 and/or any response resources server 110.

A launch subsystem 310 (e.g., launch device) deploys a force toward a target. Deployment generally includes propelling an object and/or a gas toward a target. Objects may include sensors, biometric sensors, bugs, nonlethal force (rubber bullets, pepper spray, tear gas, wire-tethered electrodes, electrified projectiles), or lethal force (e.g., electric shock, poisons, bullets, grenades). Launch subsystems 310 may report their capabilities to processing subsystems 304. A launch subsystem 310 may detect and report installed cartridges and/or projectiles of various types. Cartridge and projectile types connote capabilities of a deployable force (e.g., effective range, rate of separation with distance, accuracy, impact energy, sensitivity, maximum and minimum physical phenomena detectable). A launch device may report remaining deployment capabilities after a deployment.

Cartridge 314 or plurality of cartridges 312 (e.g., magazine) includes a plurality of wire-tethered electrodes for launch toward a target. Launch subsystems 310 may launch any number of electrodes toward a target. Launch subsystems 310 may stimulate a target to immobilize the target with a current provided through any of the electrodes (e.g., any pair) having suitable relative polarity and contact with the target. A stimulus may include unipolar and/or bipolar pulses of current. A cartridge 314 may include a propellant to launch the wire-tethered electrodes. A cartridge, as discussed above, may be useful for a single deployment or may operate as a magazine for multiple deployments. A cartridge may include a pair of wire-tethered electrodes.

A projectile 318 of plurality 316 may include a wireless electrified projectile, a bug, a sensor, or a biometric circuit as discussed above. A projectile may perform a marking function (e.g., release a dye not apparent to the target, affix a beacon and/or transponder that provides an identifying message for tracking the location of the target).

A target surveillance subsystem uses sensors to acquire data about an area. A target surveillance subsystem and/or processing subsystems analyze data collected by sensors to detect indicia of a target. Data may include video (e.g., one or more images), audio (e.g., voice, human inaudible sound such as from a dog whistle, foot steps), electromagnetic radiation (e.g., flashlight beam, cell phone transmissions, radio transmissions, thermal disturbances (e.g., body heat), and mechanical disturbances (e.g., vibration). Analysis may be used to detect indicia of a target (e.g., movement, man-made noise, electromagnetic signals characteristic of man-made use, vibration, vehicle noises).

Figure 4:
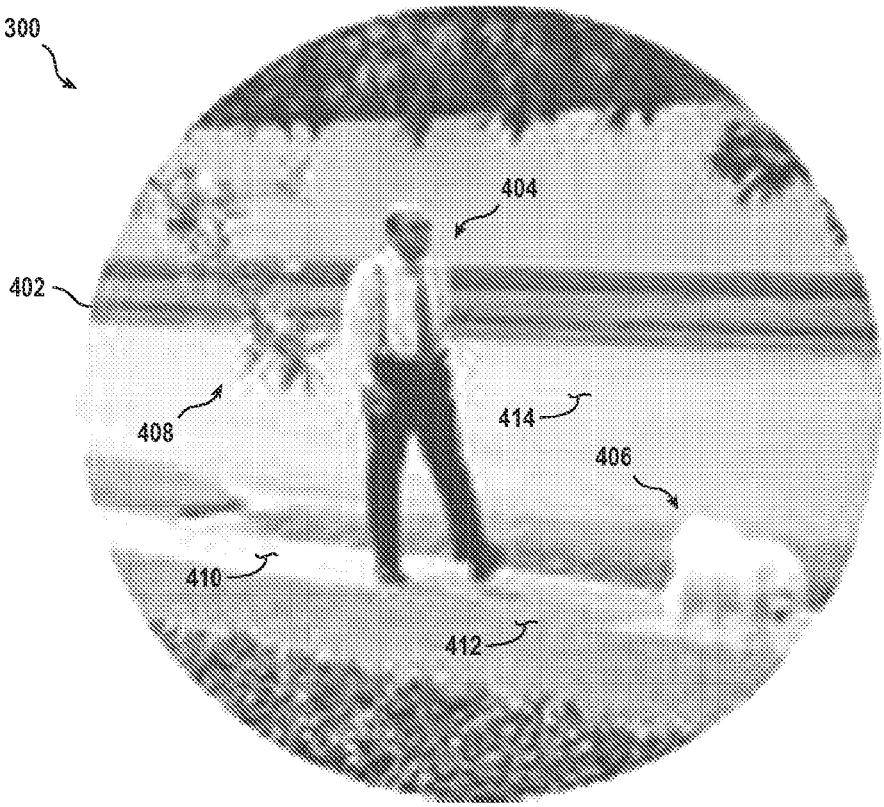
FIG. 4 is an image of a scene for video analysis by the system of FIG. 1.

In one implementation, surveillance subsystems 320 include a wide angle camera that provides a field of view large enough to cover denial zone 202 to an extent suitable for planning deployments 212, 214, and 216. Area denial node 106 may acquire an image (e.g., a video frame) in any conventional manner and analyze an image or succession of images, according to various aspects of the present invention, to reliably describe and classify targets for one or more effective deployments. For example, image 402 of FIG. 4 is a monochrome image representing light (e.g., infrared, visible, or ultraviolet) from a real world scene. For the sake of discussion, image 402 includes target 220 of FIG. 2 after target 220 has moved into denial zone 202. Image 402 includes man 404, dog 406, branch 408, sidewalk 410, lawn 412, and street 414.

Figure 5:
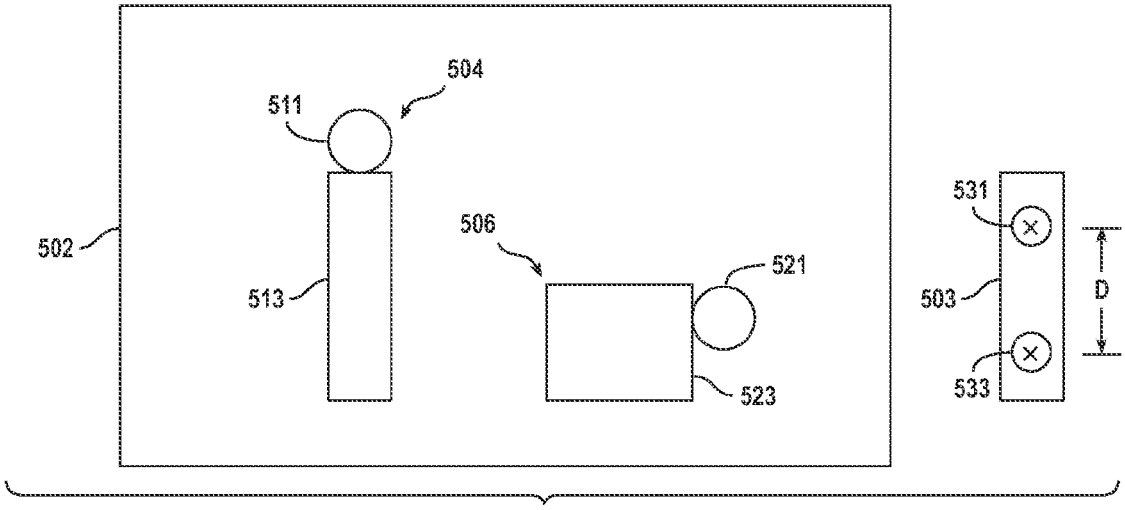
FIG. 5 is a two dimensional plan view and a force pattern, the plan view is of the image of FIG. 4 representing results of target description and target classification.

Analysis of image 402 may include the description and classification of the elements of image 402 including a target. Analysis of the elements of image 402 may results in any conventional data representation (e.g., vectors, geometric descriptions). Data representations (e.g., models) of an image may be stored in a memory or similar media for use by any subsystem of area denial node 106 or any component of system 100. For clarity of discussion, such data is represented in FIG. 5 as a two dimensional plan view 502 of the image 402. Plan view 502 includes form 504 representing man 404 and form 506 representing dog 406.

According to various aspects of the present invention, for any deployed force, an effect at a particular plane (e.g., perpendicular to segment AE) that includes the target may be estimated (e.g., predicted) and described (e.g., scaled) as a planar force pattern. For example, the impact locations and separation of two wire-tethered electrodes may be estimated with respect to a target. A force pattern may be superimposed over a boundary of a target. System 100, or a part thereof (e.g., area denial node 106), may test the correspondence (e.g., overlap, enclosure, containment) between a force pattern 503 and a boundary 513 of a target or portion of a target. A force pattern, a boundary, and an image of the target may be presented in a display on a user interface of the type discussed above. Such a display may aid in deployment authorizations discussed above (e.g., of the type referred to as man-in-the loop).

The efficacy of deploying a force against a target may be predicted, according to various aspects of the present invention, by testing whether at least one criterion is met by a comparison of a predicted force pattern (e.g., scaled for range to the expected location of the target) and a description of the target (e.g., an area, boundary). If at least one criterion is met, use of force for area denial is deemed likely to be successful. Testing may include consideration of, inter alia, at least one of determining whether the force pattern suitably overlies (e.g., intersects, is contained within) a boundary of the target, determining whether two or more predicted locations of impact on a target lie within a boundary of an area of the target, and determining a physical and/or electrical distance between two or more predicted locations of impact on a target. Criteria that may be used to determine a binary result of testing (e.g., go or no-go for a launch decision) may include whether overlap of a force pattern and a model (e.g., including a boundary) of a target exceeds a threshold extent (e.g., a value greater than 50%, preferably greater than 80%), whether at least two predicted locations of impact on the target are likely (e.g., a value greater than 40%, preferably greater than 80%), whether a predicted physical distance between locations of impact of at least two objects on the target will exceed a threshold estimated physical distance between the predicted impact locations (e.g., a value of 5 inches or more, preferably 6 inches), whether a predicted electrical distance between locations of impact of at least two objects on the target will exceed a threshold estimated physical distance between the predicted impact locations (e.g., a value of 5 inches or more, preferably 6 inches), whether an impact of an object on the face of the target is unlikely (e.g., a value of less than 40% chance of impact with the face, preferably less than 20%).

For example, planar geometric models (e.g., FIGS. 5-10) may be used to test whether a force pattern satisfies one or more criteria. For each test a processor may access a stored representation of a force pattern, a stored representation of the target (e.g., a geometric boundary), and a criterion using any conventional graphical or geometric modeling technology. In FIGS. 5-10 a prediction (e.g., force pattern 503) for two electrodes (e.g., from cartridge 314 or projectile 318) is compared by planar geometry to a respective boundary of a target (e.g., 513, 604, 704, 804, 904, and 1004). The distance between electrodes launched by an area denial node may increase with distance from the launch device. In each force pattern, predicted locations of impact of an electrode at the target are indicated with the symbol "X." A distance D indicates a predicted average physical distance between (e.g., average spread of) the electrodes. Based on results of geometric tests, area denial node 106 may identify the corresponding deployment as a planned deployment. If preauthorized or subsequently authorized as discussed above, a launch signal is provided from processing subsystems 304 to launch subsystems 310.

Figure 6:
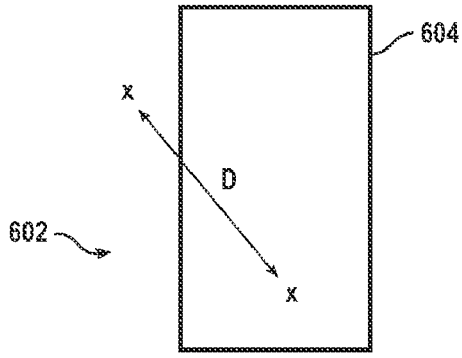
FIG. 6 is a planar geometric model of a force pattern and a target boundary.
Figure 7:
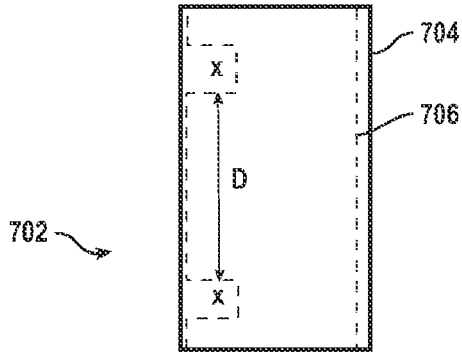
FIGS. 7-9 are planar geometric models of force patterns and target boundaries illustrating adjustments to the respective target boundary.
Figure 8:
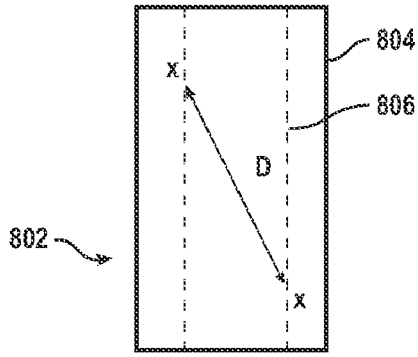
Figure 9:
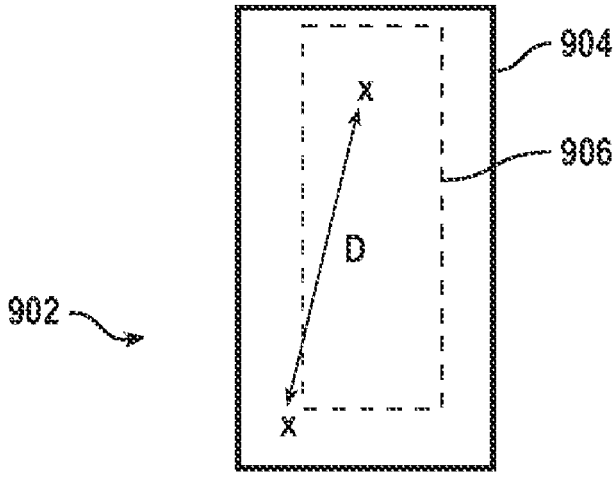
Figure 10:
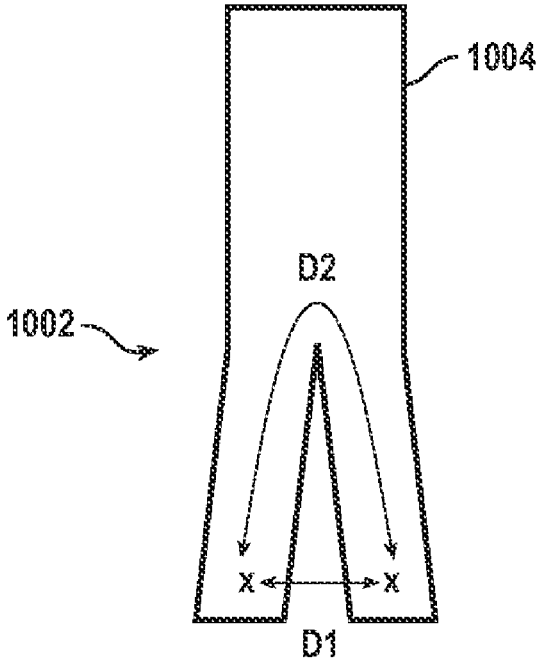
FIG. 10 is a planar geometric model illustrating physical distance and electrical distance between portions of a force pattern.

In the example of FIG. 6, testing of force pattern 602 using boundary 604 reveals that only one electrode is predicted to impact the target. As a result, a deployment corresponding to force pattern 602 is not planned.

In other examples, each estimated location of impact of force patterns 702, 802, and 902 are contained within a target boundary (both locations lie within the target boundary 704, 804, and 904 respectively) and the distance D between the two locations is greater than a threshold. Accordingly, a deployment corresponding to force patterns 702, 802, and 902 is planned.

An area denial node, according to various aspects of the present invention, may adjust its operation (e.g., predicting, testing, classifying) in accordance with a result of any function performed by the area denial node and/or data obtained from any source (e.g., criteria, force patterns, target boundaries). An area denial node may adjust for a successful area denial in accordance with any result of a past area denial attempt. An area denial node may adjust target description, target classification, planned deployments, and/or control of deployments in accordance with a past immobilization attempt, additional target analysis, additional surveillance, and/or information from another area denial node.

For example, an area denial node may adjust its description of a target in response to area denial action. For example, area denial node 106 deploys two electrodes according to force pattern 702 because the force pattern met at least one criterion. If force pattern 702 does not effectively immobilize the target (e.g., actual impact of at least one electrode on loose clothing too far from target flesh), then area denial node 106 adjusts its detected target boundary from boundary 704 to boundary 706. Boundary 706 excludes the locations of impact of force pattern 702, thus any new force pattern is tested against adjusted boundary 706 (e.g., assumed increased probability of target flesh) before planning a deployment of force. A boundary may be adjusted in any manner as a result of an ineffective prior deployment of force as shown by adjusted boundaries 706, 806, and 906.

A successful area denial may be detected by detecting a halt in target movement and/or delivery of a suitable stimulus current through the target. Detecting an output impedance of a stimulus delivery circuit may provide indicia of delivery of the current through the target. Detecting a decrease in a capacitor voltage may indicate delivery of current through the target. A current monitor circuit (e.g., shunt with voltage analog to digital converter to processor) may be used.

Testing a distance between two estimated locations of electrode impact may be accomplished by measuring a distance between the estimated locations and a distance through target flesh between the estimated locations. Distance D between estimated locations of impact of force patterns 503, 602, 702, 802, and 902 provides a physical distance between the estimated locations that happens to correspond to the electrical distance through target flesh. Distance D1 between estimated locations of impact of force pattern 1002 of FIG. 10 indicates the physical distance between the locations while distance D2 indicates an estimated electrical distance through target flesh as indicated by boundary 1004. Distance D1 may be less than a threshold for a successful area denial while distance D2 may be greater than the threshold for a successful area denial.

Distance D2 and target boundary 1004 may be determined by image analysis of video provided by sensors discussed above.

Each "x" 531, 533 on force pattern 503 indicates a reference location (e.g., a center) of a projection of probable impact associated with one electrode (or a linked group of electrodes). Each projection of probable impact is associated with a confidence factor. The confidence factor expresses a probability that the electrode (or linked group) will impact the target within the locus of points on the target that correspond to the projection of probable impact. To test whether a force pattern is likely to be effective against a target, a planar projection of probable impact and a boundary 503 of the target 513 may be compared (e.g., as an overlay). If the projections are fully within the boundary, a launch is likely to result in successful impact, consequently successful inhibiting of locomotion accomplishing area denial.

Various confidence factors may be used. For example, if a confidence factor of 80% is selected for an initial launch, testing indicates likely success, but the target's course into the denial zone is not changed, a higher confidence factor (e.g., 95%) may be selected for a subsequent launch with the expectation that a better opportunity will arise. If the expectation is that no better launch is expected, the same or lower confidence factor may be selected for subsequent launches.

Each confidence factor prescribes a different projection of probable impact. Lower confidence factors generally prescribe projections having greater planar area. In addition or alternatively to adjusting the confidence factor, an adjustment may be made to the extent of comparison that yields a positive result of likely successful area denial. Comparing may be relaxed to require less than full overlap, as discussed above. For example, comparing may provide a positive result when at least a large percentage (e.g., any percentage between 60% and 99%) of the projection overlaps the plan view of the target (e.g., is within a boundary of the target).

Projections of probable impact 531, 533 are indicated in FIG. 5 as circles though any other shape may be used (e.g., ellipse, tear drop, square, rectangle, polygon). Projections of probable impact are not shown in FIGS. 6-10 for clarity of discussion. The distances D, D1, and D2 may be measured from any convenient aspect of a projection of probable impact.

Target surveillance subsystems 320 may include a source of illumination to enhance collection of video data of an area and improve detection of indicia of a target. Area denial nodes 106 and 232 may cooperate with each other to illuminate a target. Illumination is not limited to the visible light spectrum, but may include infra-red, RF, microwave, and laser frequency emissions.

Launch subsystems 310 may include a waveform generator that provides a current to inhibit locomotion of the target. A waveform generator may, in any order perform one or more of the following operations: select electrodes for use in a stimulus signal delivery circuit, ionize air in a gap between the electrode and the target, provide an initial stimulus signal, provide alternate stimulus signals, and respond to input (e.g., from area denial hub 102, processing subsystems 304) to control any of the aforementioned operations.

In a system that uses a current through target tissue to effect area denial, the current may be provided by any conventional waveform generator. For instance, for launch systems 310, a waveform generator of the type described solely in any of the following U.S. patents or in any combination of teachings therein may be used: U.S. Pat. No. 3,803,463 to Cover, U.S. Pat. No. 5,750,918 to Mangolds, U.S. Pat. Nos. 6,636,412 and 7,057872 to Smith, and U.S. Pat. No. 7,102,870 to Nerheim.

Figure 3:
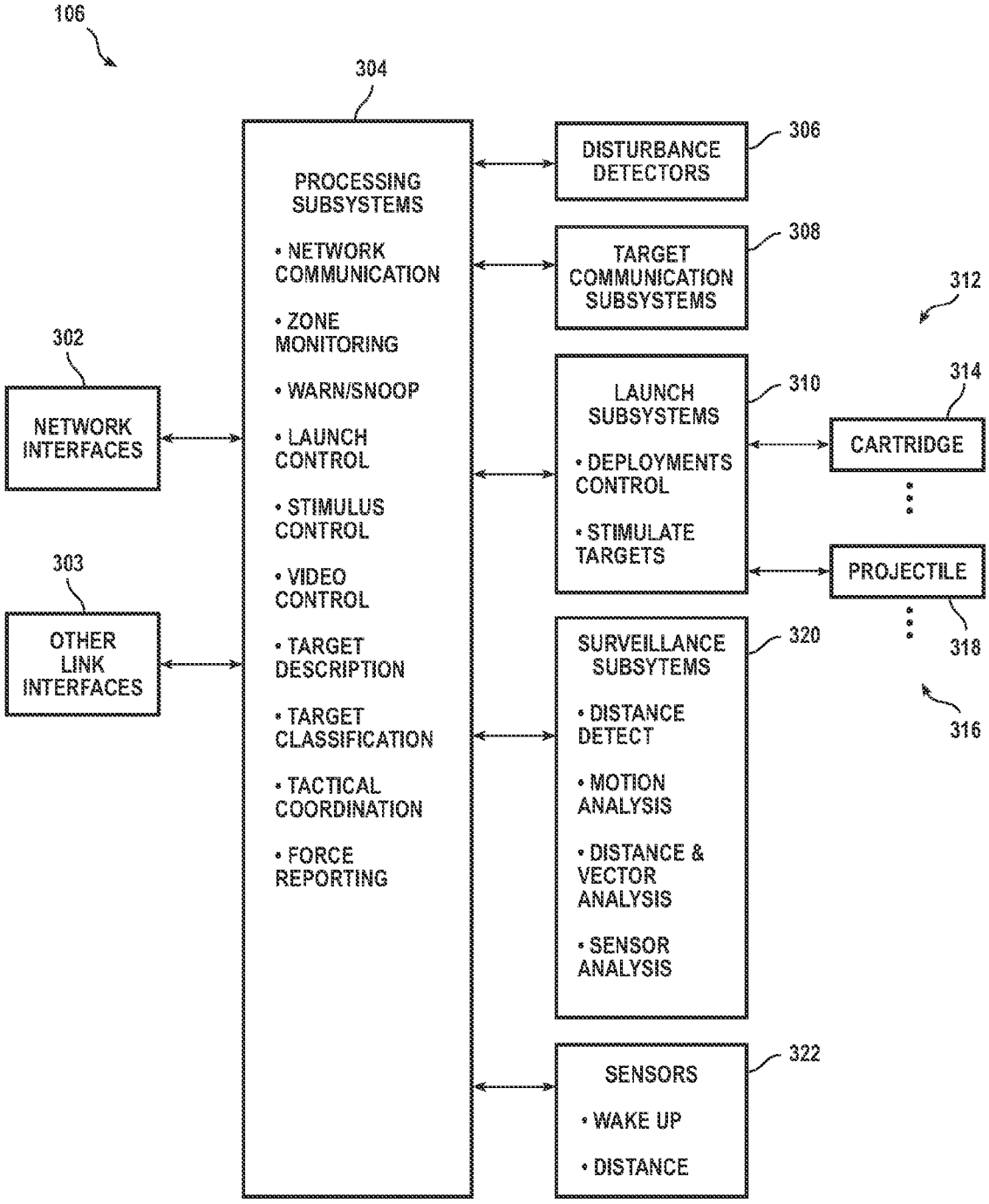
FIG. 3 is a functional block diagram of an area denial node of FIGS. 1 and 2.

In one implementation of an area denial node, a large portion of the operations discussed with reference to FIG. 3 are controlled by firmware performed by a one or more microprocessors to permit miniaturization of circuitry for stimulus signal generation and the variety of control functions.

Figure 11:
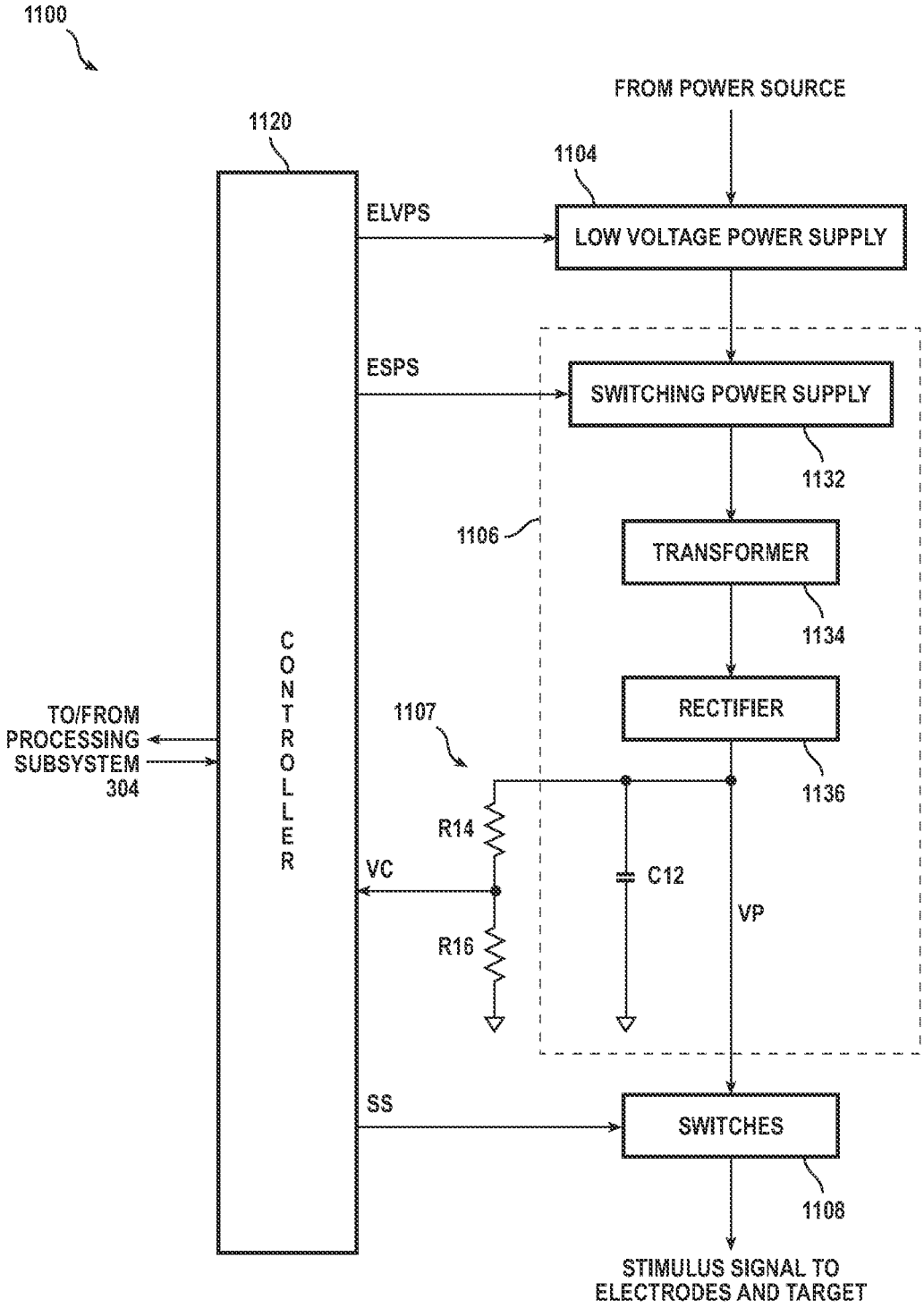
FIG. 11 is a functional block diagram of an immobilization device used in launch subsystem 310 of FIG. 3.

Particular synergies may be realized according to various aspects of the present invention in a system 100 having a waveform generator 1100 of FIG. 11 to provide a current. Waveform generator 1100 may be controlled in part by processing subsystems 304.

Waveform generator 1100 includes low voltage power supply 1104, high voltage power supply 1106, switches 1108, and controller 1120.

A low voltage power supply receives a DC voltage from a power source (not shown) and provides other DC voltages for operation of a waveform generator. For example, low voltage power supply 1104 may include a conventional switching power supply circuit (e.g., LTC3401 marketed by Linear Technology) to receive 1.5 volts from a battery (not shown) and supply 5 volts and 3.3 volts DC.

A high voltage power supply receives an unregulated DC voltage from a low voltage power supply and provides a pulsed, relatively high voltage waveform as a stimulus signal. For example, high voltage power supply 1106 includes switching power supply 1132, transformer 1134, rectifier 1136, and storage capacitor C12 all of conventional technology and provides stimulus signal VP. In one implementation, switching power supply 1132, comprising a conventional circuit (e.g., LTC1871 marketed by Linear Technology), receives 5 volts DC from low voltage power supply 1104 and provides a relatively low AC voltage for transformer 1134. A binary control signal that enables and disables switching power supply 1132 (e.g., ESPS) assures that a peak voltage of signal VP does not exceed a limit (e.g., 500 volts). Transformer 1134 steps up the relatively low AC voltage on its primary winding to a relatively high AC voltage on each of two secondary windings (e.g., 500 volts). Rectifier 1136 provides DC current for charging capacitor C12.

Switches 1108 form stimulus signal VP across electrode(s) by conducting (e.g., closing) for a brief period of time to form a current pulse; followed by opening. The discharge voltage available from capacitor C12 decreases during the pulse duration. When switches 1108 are open, capacitor C12 may be recharged to provide a same discharge voltage for each pulse.

A pulse may have a waveform consistent with a resonant circuit response driving a load. A resonant circuit driving a load may provide a waveform of the type known as underdamped 1502, of the type known as critically damped 1504, or of the type known as overdamped 1506. Variations in appearance between these types of waveforms are possible depending on the resonant circuit and the load. The inventors have found that a resistance of about 400 ohms is a suitable model for an adult human target (e.g., load) in good health and not under the influence of narcotics or alcohol. The waveform provided by circuits disclosed herein may be underdamped when delivered through an adult human load. A change in target load (e.g., impedance) may result in various pulse waveforms including a series of underdamped, critically damped, and overdamped.

Controller 1120 provides signals to processing subsystems 304 regarding control of waveform generator 1100. Controller 1120 may include a conventional programmable controller circuit having a microprocessor, memory, and analog to digital converter programmed according to various aspects of the present invention, to provide a uniform or varied (e.g., adjusted) stimulus signal through a target.

A stimulus signal includes any signal delivered via electrodes to establish or maintain a stimulus signal delivery circuit through the target and/or to inhibit locomotion by the target. The purposes of a stimulus signal may be accomplished with a signal having a plurality of stages. Each stage may comprise a period of time during which one or more pulse waveforms are consecutively delivered via a waveform generator and electrodes coupled to the waveform generator.

Stages from which a complete stimulus signal may be constructed include in any practical order: (a) a path formation stage for ionizing an air gap (e.g., forming an arc across the gap) that may be in series with the electrode to the targets tissue; (b) a path testing stage for measuring an electrical characteristic of the stimulus signal delivery circuit (e.g., whether or not an air gap exists in series with the target's tissue); (c) a strike stage for immobilizing the target; (d) a hold stage for discouraging further motion by the target; and (e) a rest stage for permitting limited mobility by the target (e.g., to allow the target to catch a breath). A repeated stage may have a repetition rate (e.g., to accomplish from 5 to 20 pulses per second, each pulse with arc formation).

An example of a compliance signal for each stage is described in FIG. 12. In FIG. 12, two stages of a stimulus signal are attributed to path management and three stages are attributed to target management. The waveform shape of each stage may have positive amplitude (as shown), inverse amplitude, or alternate between positive and inverse amplitudes in repetitions of the same stage. Path management stages may include a path formation stage and a path testing stage. Waveform shapes may overlap in time (e.g., path formation and strike).

In a path testing stage, a voltage waveform is sourced and impressed across a pair of electrodes to determine whether the path has one or more electrical characteristics sufficient for entry into a path formation, strike, or hold stage. Path impedance may be determined by any conventional technique, for instance, monitoring an initial voltage and a final voltage across a capacitor that is coupled for a predetermined period of time to supply current into electrodes. In one implementation, the shape of the voltage pulse is substantially rectangular having a peak amplitude of about 450 volts, and having a duration of about 10 microseconds. A path may be tested several times in succession to form an average test result, for instance from one to three voltage pulses, as discussed above. Testing of all combinations of electrodes may be accomplished in about one millisecond. Results of path testing may be used to select a pair of electrodes to use for a subsequent path formation, strike, or hold stage. Selection may be made without completing tests on all possible pairs of electrodes, for instance, when electrode pairs are tested in a sequence from most preferred to least preferred.

In a strike stage, a voltage waveform is sourced and impressed across a pair of electrodes. Typically this waveform is sufficient to interfere with voluntary control of the target's skeletal muscles, particularly the muscles of the thighs and/or calves. In another implementation, use of the hands, feet, legs and arms are included in the effected immobilization. The pair may be as selected during a test stage; or as prepared for conduction by a path formation stage. The shape of the waveform used in a strike stage may include a pulse with decreasing amplitude (e.g., a trapezoid shape). In one implementation, the shape of the waveform is generated from a capacitor discharge between an initial voltage and a termination voltage.

The initial voltage may be a relatively high voltage for paths that include ionization to be maintained or a relatively low voltage for paths that do not include ionization. The initial voltage may correspond to a stimulus peak voltage (SPV) as in FIG. 12. The SPV may be essentially the initial voltage for a fast rise time waveform. The SPV following ionization may be from about 3 Kvolts to about 6 Kvolts, preferably about 5 Kvolts. The SPV without ionization may be from about 100 to about 600 volts, preferably from about 350 volts to about 500 volts, most preferably about 400 volts. The initial voltage may correspond to a skeletal muscle nerve action potential.

The termination voltage may be determined to deliver a predetermined charge per pulse. Charge per pulse minimum may be designed to assure continuous muscle contraction as opposed to discontinuous muscle twitches. Continuous muscle contraction has been observed in human targets where charge per pulse is above about 15 microcoulombs. A minimum of about 50 microcoulombs is used in one implementation. A minimum of 85 microcoulombs is preferred, though higher energy expenditure accompanies the higher minimum charge per pulse.

Charge per pulse maximum may be determined to avoid cardiac fibrillation in the target. For human targets, fibrillation has been observed at 1355 microcoulombs per pulse and higher. The value 1355 is an average observed over a relatively wide range of pulse repetition rates (e.g., from about 5 to 50 pulses per second), over a relatively wide range of pulse durations consistent with variation in resistance of the target (e.g., from about 10 to about 1000 microseconds), and over a relatively wide range of peak voltages per pulse (e.g., from about 50 to about 1000 volts). A maximum of 500 microcoulombs significantly reduces the risk of fibrillation while a lower maximum (e.g., about 100 microcoulombs) is preferred to conserve energy expenditure.

Pulse duration is preferably dictated by delivery of charge as discussed above. Pulse duration according to various aspects of the present invention is generally longer than conventional systems that use peak pulse voltages higher than the ionization potential of air. Pulse duration may be in the range from about 20 to about 500 microseconds, preferably in the range from about 30 to about 200 microseconds, and most preferably in the range from about 30 to about 100 microseconds.

By conserving energy expenditure per pulse, longer durations of immobilization may be effected and smaller, lighter power sources may be used (e.g., in a projectile comprising a battery). In one embodiment, a suitable range of charge per pulse may be from about 50 to about 150 microcoulombs.

Initial and termination voltages may be designed to deliver the charge per pulse in a pulse having a duration in a range from about 30 microseconds to about 210 microseconds (e.g., for about 50 to 100 microcoulombs). A discharge duration sufficient to deliver a suitable charge per pulse depends in part on resistance between electrodes at the target. For example, a one RC time constant discharge of about 100 microseconds may correspond to a capacitance of about 1.75 microfarads and a resistance of about 60 ohms. An initial voltage of 100 volts discharged to 50 volts may provide 87.5 microcoulombs from the 1.75 microfarad capacitor.

A termination voltage may be calculated to ensure delivery of a predetermined charge. For example, an initial value may be observed corresponding to the voltage across a capacitor. As the capacitor discharges delivering charge into the target, the observed value may decrease. A termination value may be calculated based on the initial value and the desired charge to be delivered per pulse. While discharging, the value may be monitored. When the termination value is observed, further discharging may be limited (or discontinued) in any conventional manner. In an alternate implementation, delivered current is integrated to provide a measure of charge delivered. The monitored measurement reaching a limit value may be used to limit (or discontinue) further delivery of charge.

Pulse durations in alternate implementations may be considerably longer than 100 microseconds, for example, up to 1000 microseconds. Longer pulse durations increase a risk of cardiac fibrillation. In one implementation, consecutive strike pulses alternate in polarity to dissipate charge which may collect in the target to adversely affect the target's heart. In another implementation, consecutive strike stages are of alternate polarity.

During the strike stage, pulses are delivered at a rate of about 5 to about 50 pulses per second, preferably about 20 pulses per second. The strike stage continues from the rising edge of the first pulse to the falling edge of the last pulse of the stage for from 1 to 5 seconds, preferably about 2 seconds.

In a hold stage, a voltage waveform is sourced and impressed across a pair of electrodes. Typically this waveform is sufficient to discourage mobility and/or continue immobilization to an extent somewhat less than the strike stage. A hold stage generally demands less power than a strike stage. Use of hold stages intermixed between strike stages permit the immobilization effect to continue as a fixed power source is depleted (e.g., battery power) for a time longer than if the strike stage were continued without hold stages. The stimulus signal of a hold stage may primarily interfere with voluntary control of the target's skeletal muscles as discussed above or primarily cause pain and/or disorientation. The pair of electrodes may be the same or different than used in a preceding path formation, path testing, or strike stage, preferably the same as an immediately preceding strike stage. According to various aspects of the present invention, the shape of the waveform used in a hold stage includes a pulse with decreasing amplitude (e.g., a trapezoid shape) and initial voltage (SPV) as discussed above with reference to the strike stage. The termination voltage may be determined to deliver a predetermined charge per pulse less than the pulse used in the strike stage (e.g., from 30 to 100 microcoulombs). During the hold stage, pulses may be delivered at a rate of about 5 to 15 pulses per second, preferably about 10 pulses per second. The strike stage continues from the rising edge of the first pulse to the falling edge of the last pulse of the stage for from about 20 to about 40 seconds (e.g., about 28 seconds).

A rest stage is a stage intended to improve the personal safety of the target and/or the operator of the system. In one implementation, the rest stage does not include any stimulus signal. Consequently, use of a rest stage conserves battery power in a manner similar to that discussed above with reference to the hold stage. Safety of a target may be improved by reducing the likelihood that the target enters a relatively high risk physical or emotional condition. High risk physical conditions include risk of loss of involuntary muscle control (e.g., for circulation or respiration), risk of convulsions, spasms, or fits associated with a nervous disorder (e.g., epilepsy, or narcotics overdose). High risk emotional conditions include risk of irrational behavior such as behavior springing from a fear of immediate death or suicidal behavior. Use of a rest stage may reduce a risk of damage to the long term health of the target (e.g., minimize scar tissue formation and/or unwarranted trauma). A rest stage may continue for from 1 to 5 seconds, preferably 2 seconds.

In one implementation, a strike stage is followed by a repeating series of alternating hold stages and rest stages.

In any of the deployed electrode configurations discussed above, the stimulation signal may be switched between various electrodes so that not all electrodes are active at any particular time. Accordingly, a method for applying a stimulus signal to a plurality of electrodes includes, in any order: (a) selecting a pair of electrodes; (b) applying the stimulus signal to the selected pair; (c) monitoring the energy (or charge) delivered into the target; (d) if the delivered energy (or charge) is less than a limit, conclude that at least one of the selected electrodes is not sufficiently coupled to the target to form a stimulus signal delivery circuit; and (e) repeating the selecting, applying, and monitoring until a predetermined total stimulus (energy and/or charge) is delivered. A microprocessor performing such a method may identify suitable electrodes in less than a millisecond such that the time to select the electrodes is not perceived by the target.

Figure 13:
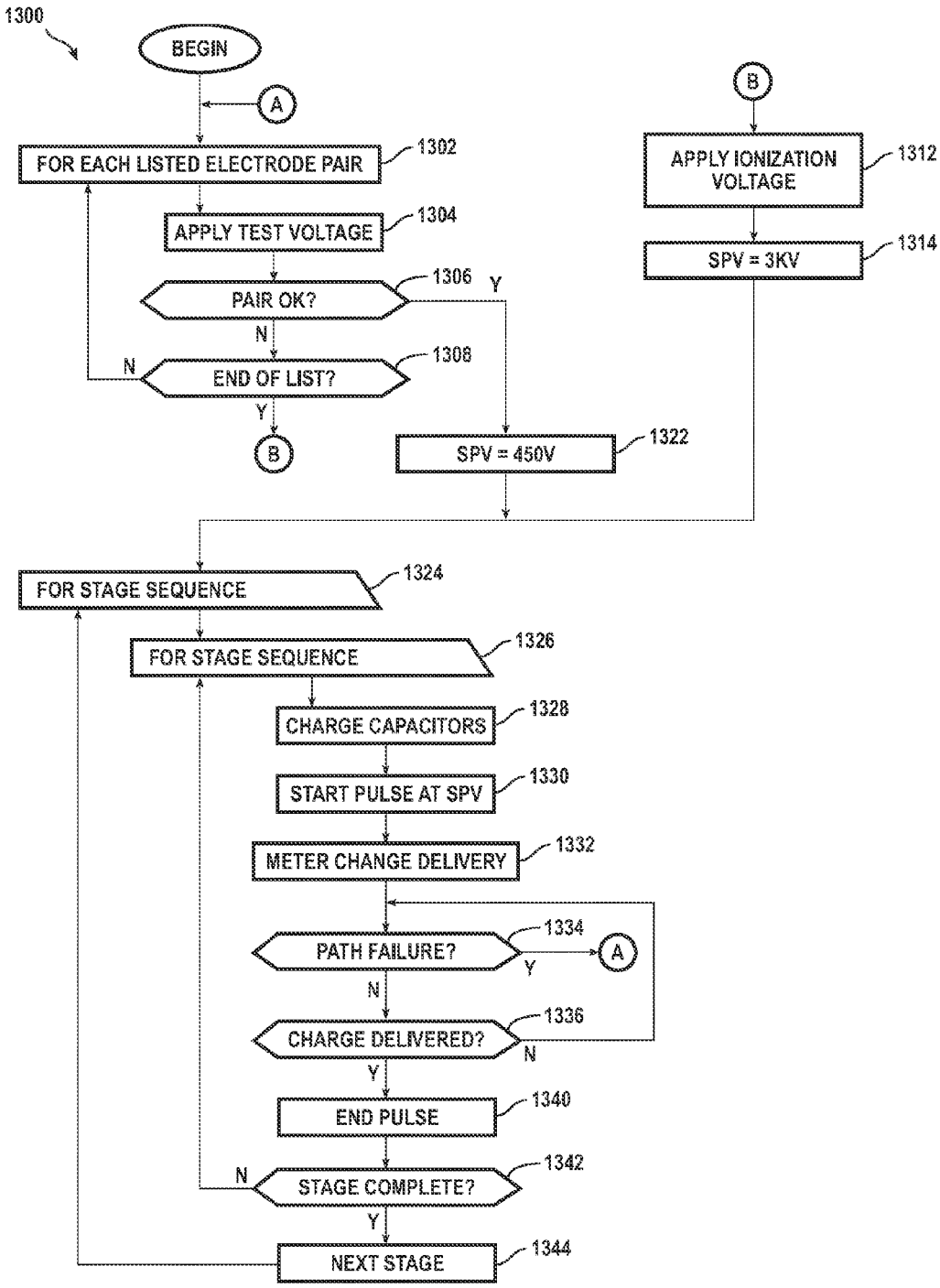
FIG. 13 is a functional flow diagram for a process performed by the immobilization device of FIG. 11.

A waveform generator as discussed above may perform a method for delivering a stimulus signal that includes selecting a path, preparing the path for the stimulus signal, and repeatedly providing the stimulus signal for a sequence of effects including in any order: a comparatively highly immobilizing effect (e.g., a strike stage as discussed above), a comparatively lower immobilizing effect (e.g., a hold stage as discussed above), and a comparatively lowest immobilizing effect (e.g., a rest stage as discussed above). For example, method 1300 of FIG. 13 is implemented as instructions stored in a memory device (e.g., stored and/or conveyed by any conventional disk media and/or semiconductor circuit) and installed to be performed by processing subsystems 304 (e.g., in read only memory).

Method 1300 begins with a path testing stage as discussed above comprising a loop (1302-1308) for determining an acceptable or preferred electrode pair. Because the projectile may include numerous electrodes, any subset of electrodes may be selected for application of a stimulus signal. Data stored in a memory accessible to processing subsystems 304 may include a list of electrode subsets (e.g., pairs), preferably an ordered list from most preferred for maximum immobilization effect to least preferred. In one implementation, the ordered list indicates one preference for one subset of electrodes to be used in all stages discussed above. In another implementation, the list is ordered to convey a preference for a respective electrode subset for each of more than one stage. Method 1300 uses one list to express suitable electrode preferences. Alternate implementations include more than one list and/or more than one loop (1302-1308) (e.g., a list and/or loop for each stage). In another alternate implementation a list includes duplicate entries of the same subset so that the subset is tested before and after intervening test or stimulus signals.

According to method 1300, after path management, a processor performs target management. Path management may include path formation, as discussed above. Target management may be interrupted to perform path management as discussed below (1334). For target management, processing subsystems 304 provides the stimulus signal in a sequence of stages as discussed above. In one implementation a sequence of stages is effected by performing a loop (1324-1344).

For each (1324) stage of a predefined stage sequence, a loop (1326-1342) is performed to provide a suitable stimulus signal. Prior to entry of the inner loop (1326-1342), a stage is identified. The stage sequence may include one strike stage, followed by alternating hold and rest stages as discussed above.

For the duration of the identified stage (1326), processing subsystems 304 charges capacitors (1328) (e.g., C12 used for signal VP) until charge sufficient for delivery (e.g., 100 microcoulombs) is available or charging is interrupted by a demand to provide a pulse (e.g., processing subsystems 304, a result of electrode testing, or lapse of a timer). Processing subsystems 304 then forms a pulse (e.g., a strike stage pulse or hold stage pulse) at the value of SPV set as discussed above (1322 or 1314). Processing subsystems 304 meters delivery of charge (1332), in one implementation, by observing the voltage (e.g., VC) of the storage capacitors decrease (1336) until such voltage is at or beyond a limit voltage (e.g., about 228 volts). The selection of a suitable limit voltage may follow the well known relationship: $\Delta Q = C\Delta V$ where Q is charge in coulombs; C is capacitance in farads; and V is voltage across the capacitor in volts.

During metering of charge delivery, processing subsystems 304 may detect (1334) that the path in use for the identified stage has failed. On failure, processing subsystems 304 quits the identified stage, quits the identified stage sequence, and returns (1302) to path testing as discussed above.

When the quantity of charge suitable for the identified stage has been delivered (1336), the pulse (e.g., signal VP) is ended (1340). The voltage supplied after the pulse is ended may be zero (e.g., open circuit at least one of the identified electrodes) or a nominal voltage (e.g., sufficient to maintain ionization).

If the identified stage is not complete, then processing continues at the top of the inner loop (1326). The identified stage may not be complete when a duration of the stage has not lapsed; or a predetermined quantity of pulses has not been delivered. Otherwise, processing subsystems 304 identifies (1344) the next stage in the sequence of stages and processing continues in the outer loop (1324). The outer loop may repeat a stage sequence (as shown) until the power source for waveform generator is fully depleted.

For each (1302) listed electrode subset, processing subsystems 304 applies (1304) a test voltage across an identified electrode subset. In one implementation, processing subsystems 304 applies a comparatively low test voltage (e.g., about 500 volts) to determine an impedance of the stimulus signal delivery circuit that includes the identified electrodes. Impedance may be determined by evaluating current, charge, or voltage. For instance, processing subsystems 304 may observe a change in voltage of a signal (e.g., VC) corresponding to the voltage across the a capacitor (e.g., C12) used to supply the test voltage. If observed change in voltage (e.g., peak or average absolute value) exceeds a limit, the identified electrodes are deemed suitable and the stimulus peak voltage is set to 450 volts. Otherwise, if not at the end of the list, another subset is identified (1308) and the loop continues (1302).

In another implementation, processing subsystems 304 applies a comparatively low test voltage (e.g., about 500 volts) with delivery of a suitable charge (e.g., from about 20 to about 50 microcoulombs) to attract movement of the target toward an electrode. For example, movement may result in impaling the target's hand on a rear facing electrode thereby establishing a preferred circuit through a relatively long path through the target's tissue. In one implementation, the rear facing electrode is close in proximity to electrodes of the subset and is also a member of the subset. Alternatively, the rear facing electrode may be relatively distant from other electrodes of the set and/or not a member of the subset.

The test signal used in one implementation has a pulse amplitude and a pulse width within the ranges used for stimulus signals discussed herein. One or more pulses constitute a test of one subset. In alternate implementations, the test signal is continuously applied during the test of a subset and test duration for each subset corresponds to the pulse width within the range used for stimulus signals discussed herein.

If at the end of the list no pair is found acceptable, processing subsystems 304 identifies a pair of electrodes for a path formation stage as discussed above. Processing subsystems 304 applies (1312) an ionization voltage to the electrodes in any conventional manner. Presuming ionization occurred, subsequent strike stages and hold stages may use a stimulus peak voltage to maintain ionization. Consequently, SPV is set (1314) to 3 Kvolts.

A stage may include a compliance signal; or, a compliance signal group in a burst (e.g., 2 to 20 pulses in 50 to 500 microseconds). For example, when all pulse waveforms are identical and regularly separated in a sequence in time, the compliance signal group may be characterized by a repetition rate. In other implementations, a compliance signal group may include a variety of different pulse waveforms (e.g., the pulses having a different purpose such as to primarily cause pain and/or to primarily interfere with skeletal muscles) and a variety of separations (e.g., increasing, decreasing, increasing and decreasing, random).

Generally, a compliance signal group accomplishes the purpose of a stage (e.g., strike, hold). The one or more pulse waveforms of a compliance signal group may be tailored in intensity (e.g., quantity, rate, or amplitude of energy, current, voltage, or charge). Consequently, a compliance signal group may include adjusted compliance signals that may be dissimilar in magnitude.

Pulse waveforms may be interleaved and in series. For example, higher and lower intensity compliance signals may be delivered to the same target. In another example, a series of pulse waveforms may be delivered to multiple targets simultaneously. In still another example, a series of pulse waveforms may be delivered to several targets where each target receives a next pulse waveforms of the series. For instance, the pulse waveforms (e.g., one pulse per target) received by each target may have a pulse repetition rate, consequently the pulse repetition rate of the series may be a multiple of the pulse repetition rate received by each target.

In the path formation stage, a waveform shape may include an initial peak (voltage or current), subsequent lesser peaks alternating in polarity, and a decaying amplitude tail. The initial peak voltage may exceed the ionization potential for an air gap of expected length (e.g., about 50 Kvolts, preferably about 10 Kvolts). A subsequent stage immediately follows or overlaps in time so as to maintain the ionization. In one implementation, the path formation stage and strike stage are combined as one compliance waveform (e.g., one pulse), formed as a decaying oscillation from a conventional resonant circuit. One waveform shape having one or more peaks may be sufficient to ionize and maintain ionization of a path crossing a gap (e.g., air). Repetition of applying such a waveform shape may follow a path testing stage (or monitoring concurrent with another stage) that concludes that ionization is needed and is to be attempted again (e.g., prior attempt failed, or ionized air is disrupted).

Figure 14:
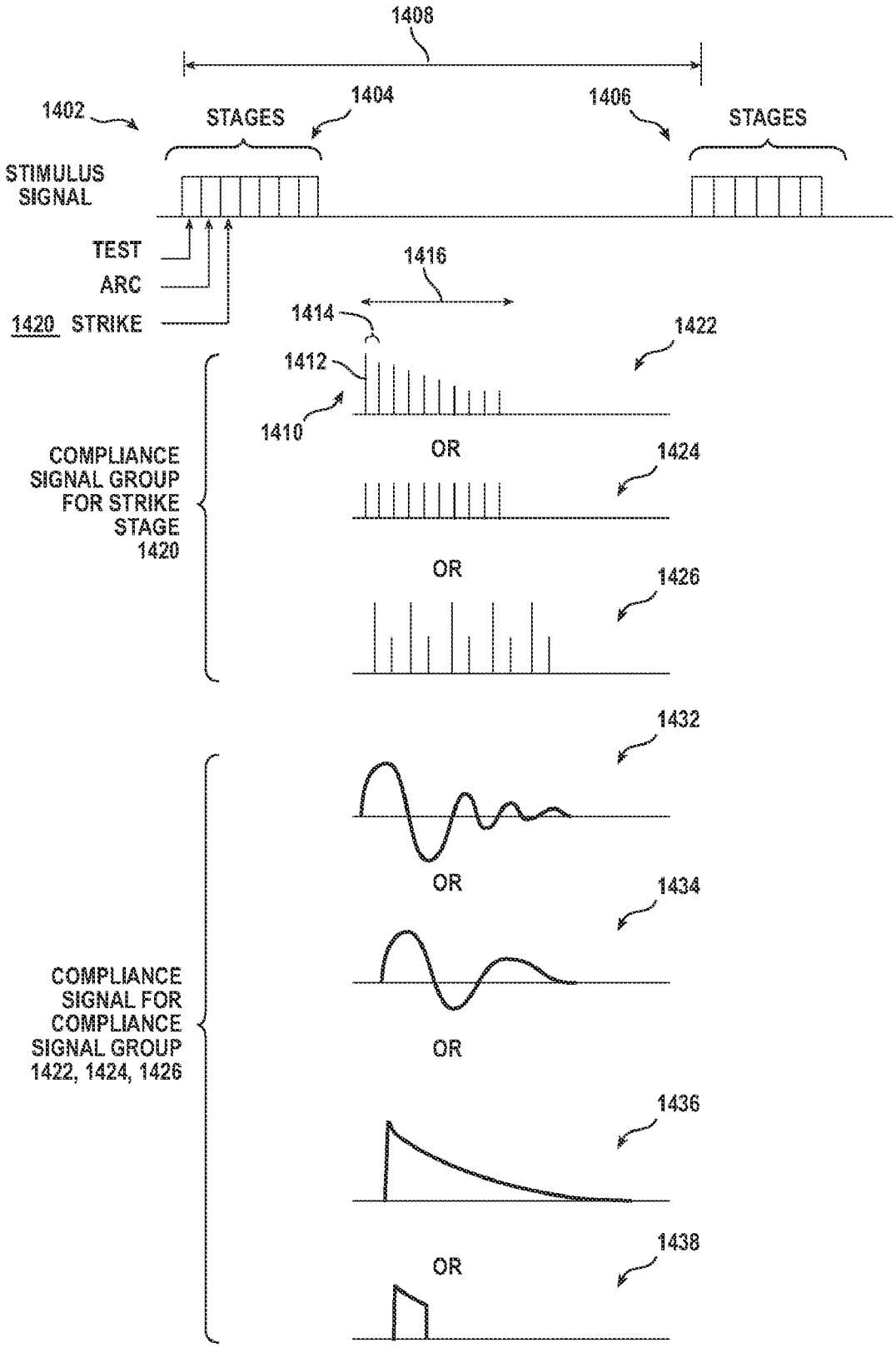
FIG. 14 is a group of timing diagrams for various stimulus signals at electrodes of the system of FIGS. 1, 3, and 11.
Figure 15A:
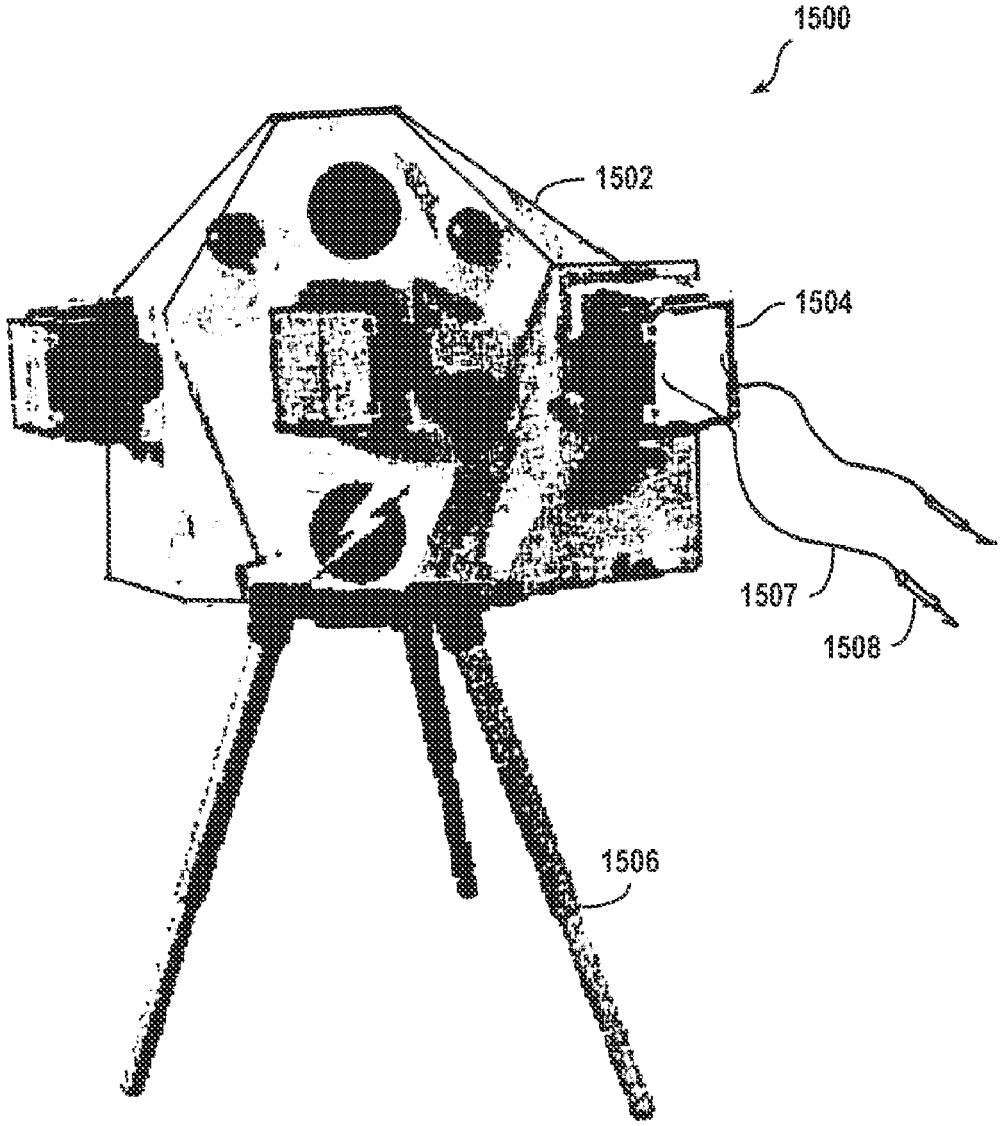
FIG. 15A is a plan view of an area denial node of system 100 according to various aspects of the present invention that launches wire tethered electrodes.
Figure 15B:
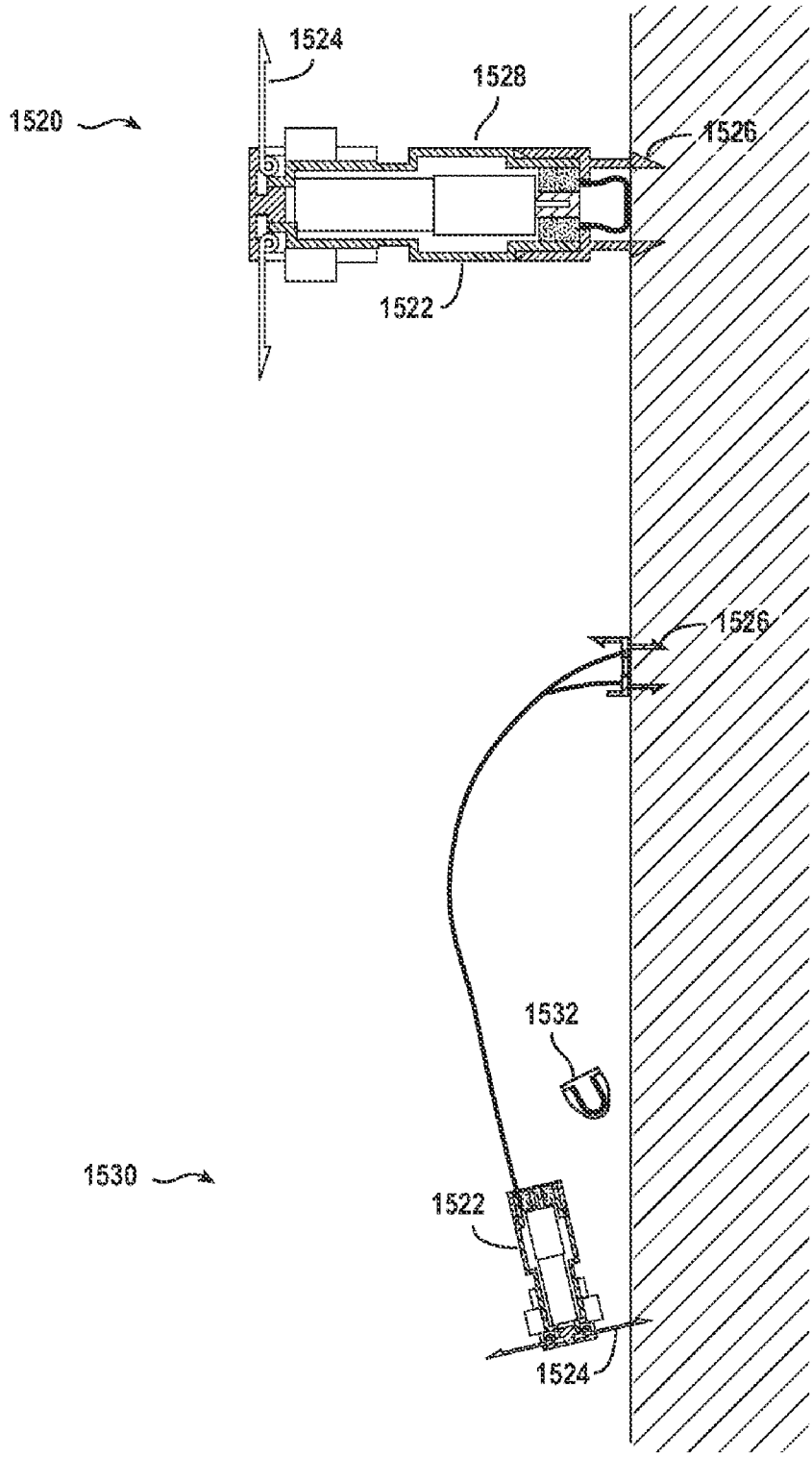
FIG. 15B is a cross-section view of two electrified projectiles launched from an area denial node of system 100 according to various aspects of the present invention.
Figure 16:
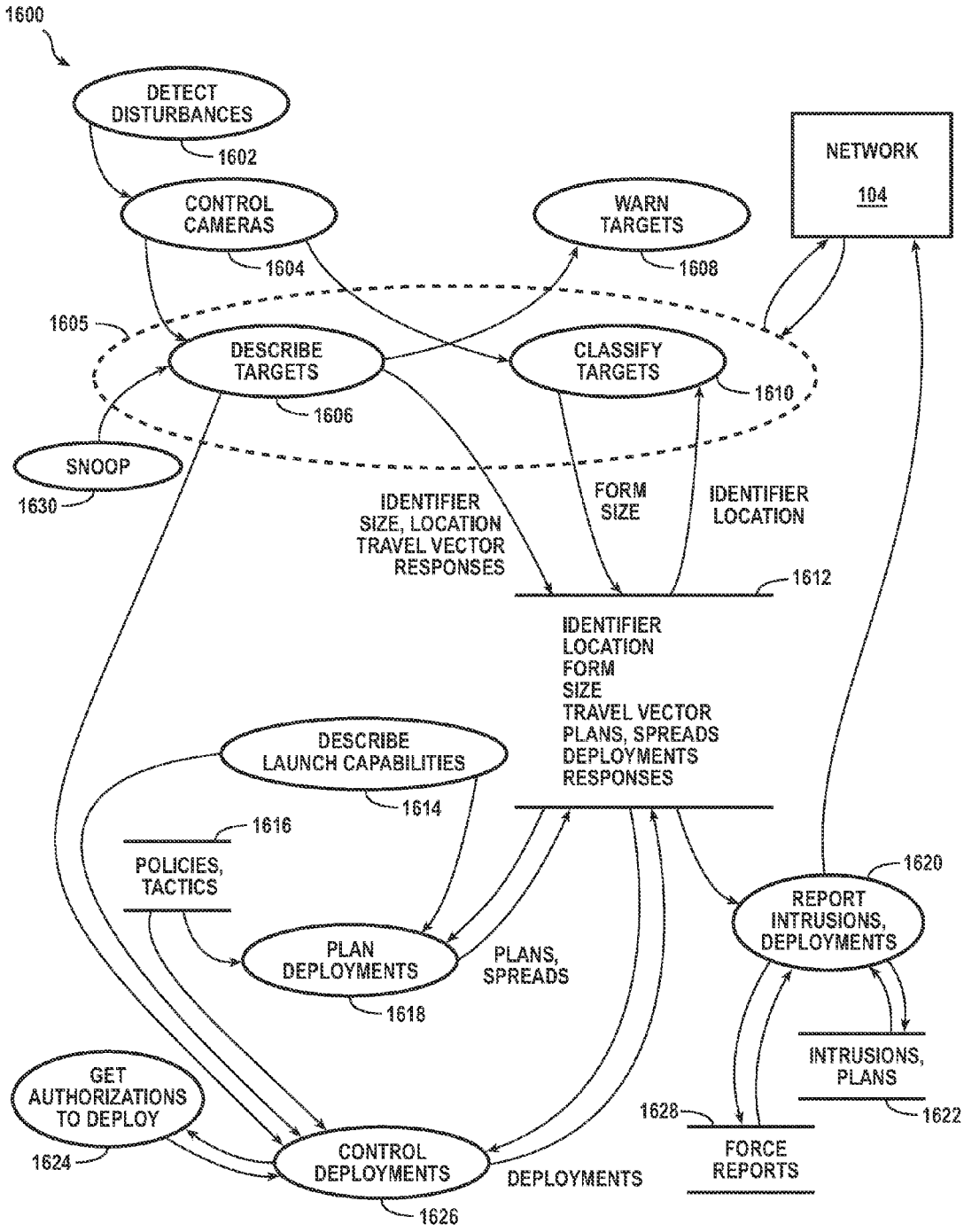
FIG. 16 is a data flow diagram of a method performed by an area denial node of FIGS. 1, 2, and 3.

Examples of stimulus signal timing relationships are shown in FIG. 14. Stimulus signal 1402 comprises multiple identical groups of stages. First group 1404 is repeated as group 1406 for a stage repetition rate determined by period 1408. Group 1404 includes a test stage, a path (arc) formation stage, and a strike stage 1420. Strike stage 1420 includes a selected series 1422, 1424, or 1426 of compliance signals. For example, strike stage 1420 may include compliance signal group 1422 which consists of 10 pulses of decreasing amplitude for a burst duration defined as period 1416. The width of each compliance signal 1412 may be uniform and relatively short in comparison with period 1416. The magnitude of successive compliance signals in each series (compliance signal group) may decrease 1422 (e.g., to conserve power), remain generally constant 1424, or alternate 1426 (to conserve power). Each compliance signal (e.g., 1412) of a compliance signal group (e.g., 1422, 1424, or 1426) may correspond generally to an underdamped waveform 1432, 1434 a critically damped waveform (not shown), or an overdamped waveform 1436, 1438. A compliance signal may be abruptly terminated 1438 as discussed above with reference to method 1300 (1332, 1342).

An area denial system may be housed in one or more free standing units. For example, area denial system 100 consisting of one area denial node 1500 of FIG. 15 comprises a case 1502, three cartridges 1504 and a tripod 1506 for support on uneven ground. Each cartridge 1504 is of the type marketed by TASER International for use with model M26 and X26 hand-held electronic control devices. Cartridge 1504 launches two wire tethered electrodes 1508 comprising tether wire 1507 (up to 35 feet in length).

Electrified projectiles may comprise a set of linked electrodes. For example, electrified projectiles 1520 and 1530 of FIG. 15B (e.g., 12 gauge, 40 mm) includes a body 1522, a battery operated waveform generator 1528, rear electrodes 1524 and front electrodes 1526. After impact with the surface of a target, projectile 1520, 1530 may separate as shown leaving front electrodes 1526 at a first location and rear electrodes 1524 to engage the target at a second location. The first and second locations may correspond to the "x" marks in FIGS. 5-10.

Methods, discussed herein, performed by system 100 may be performed by any combination of the sensing, detecting, surveillance, computing, analyzing, communicating, adjusting, and launching capabilities of the available components of the system. For example, an area denial node 106 may perform methods 1600 of FIG. 16. Some of methods 1600 may be distributed to other components communicating via network 104. For local autonomy methods 1600 may be performed entirely by node 106, for example, by processing subsystems 304 and/or surveillance subsystems 320.

A dataflow diagram describes the cooperation of processes that may be implemented by any combination of serial and parallel processing. In a fully parallel implementation, an instance of each required process is instantiated when new or revised data for that process is available; or, a static set of instances share processing resources in a single or multi-threaded environment, each process operating when new or revised data is available to that process.

Detect disturbances process 1602 reads sensors and for each disturbance reports an event with a description of the event that may include any of: general location, duration, date/time, sensor type, and sensor ID.

Control cameras process 1604 enables, orients, and focuses any cameras for image pick up and video. Process 1604 provides images (e.g., stills, sequences, sets) for video analysis.

Target analysis process 1605 includes determining target descriptions and classifying targets. In as much as a target's classification is a descriptor of the target, the distinction between description and classification may be minimal in various implementations.

Process 1605 may receive target information acquired by another area denial node and/or from area denial hub via network 104. Target received from another source may include data that has been analyzed, at least in part, by another component of system 100. For example, area denial hub 102 may receive video images from various area denial nodes 106, analyze the images to detect indicia of a target reported in more than one image, and send the results of the analysis to each area denial node 106 that may benefit from such information (e.g., reported target is in range of a particular area denial node). Information may include a target boundary, results from prior deployments, and adjustments made as described above.

Describe targets process 1606 assigns an identifier to each target. (e.g., The identifier may be associated with a bug having an identifier (e.g., RFID tag) deployed to the target). Process 1606 analyzes images from process 1604 and determines a size (e.g., of the image), location (e.g., of the image absolute or relative), travel vector (e.g., direction, rate of locomotion, acceleration), and any responses to the use of force (e.g., target is moving but not traveling, target is screaming, shaking, fallen). Process 1606 may further determine a status of the target (e.g., moving, stopped, fallen, injured, exiting denial zone). Process 1606 may follow up on each disturbance and monitor changes in target status, size, location, and/or travel vector. Results of description are stored in store 1612.

Warn targets process 1608 issues warnings as discussed above. In addition, a target may be warned to move into an area where deployment will be more effective and/or expose the target to less risk of injury. For example, a policy or tactic may dictate that a planned deployment be preceded with a warning to man 404 to move onto lawn 412 to avoid falling (under influence of a stimulus signal) onto the sidewalk or into the street thereby sustaining injury (e.g., head injury, struck by a vehicle).

Classify targets process 1610 reads store 1612 and analyzes images from process 1604, target information (e.g., size, distance), and responses to deployments of force (e.g., successful, unsuccessful). Process 1610 determines whether a form is suitable to be associated with the target. For example, for an area denial system concerned with human intruders, process 1610 recognizes that the image(s) and/or motion(s) of branch 408, street 414, sidewalk 410, and lawn 412 do not have the geometry of human appearance or human motion. No form is therefore associated to those portions of the image. Process 1610 recognizes man 404 and dog 406 to have geometry (e.g., a face derived from face recognition logic) and motion (e.g., ambulation) consistent with a form for human and/or animal. Process 1610 consequently reports form (504, 506), size (e.g., of the object from distance and perspective), and location (of the object in three-dimensional space). Process 1610 may determine a boundary for each target (e.g., 504, 506) and an acceptable area for deployment of a force according to a policy (e.g., 513, 523, no face shots). Process 1610 may adjust a boundary for a target in accordance with a response to a previous deployment. Process 1610 may periodically update this information for each identified target and write information to store 1612.

Data store 1612 stores information for each target. Any data storage technology may be used. Information for each target may be stored in a record or in a linked list or hierarchy of records. Data store 1612 may store intermediate data produced by one process for use by another process.

Describe launch capabilities process 1614 periodically obtains up to date launch capabilities from launch subsystems 310 and provides descriptions to plan deployments process 1618.

Data store 1616 stores information about policies, tactics, and criteria for successful immobilization. A policy or a tactic may be stored in any conventional manner (e.g., rules for expert system technology).

Plan deployments process 1618 reviews policies, tactics, and criteria from store 1616, current launch capabilities from process 1614, and target information, spread, and responses to prior deployments from store 1612. Using the information, process 1618 forms a prediction of at least two locations of electrode impact on a target, determines a distance between a pair of the at least two locations, and tests the prediction with at least one criterion for a successful immobilization. Based on the input, predictions, and testing, process 1618 selects suitable deployment(s) to be used against each target in store 1612. Results may be stored with the target information in store 612.

Report intrusions and deployments process 1620 from time to time reads target information and forwards reports to any area denial hub via network 104. Any area denial hub may subscribe to such reports.

Data store 1622 stores past intrusions and planned deployments that may be reviewed by a process (not shown) for evaluation of policy. Process 1618 may review data from store 1622 to avoid planned deployments that were unsuccessful.

Data store 1628 stores information about past actions and uses of force. The date/time, target description, and any other data may be included in such information organized for chronological access. This information may be reported from time to time by process 1620.

Get authorizations to deploy process 1624 prepares a message for transmission to an area denial hub 102 and tracks receipt of a response. If no response is received, a message may be sent to an alternate area denial hub or response resources server 110. Permission for a particular deployment or for a class of deployments may is reported to process 1626.

Control deployments process 1626 controls launch subsystems 310 for propulsion of projectiles from any suitable source, may control delivery of appropriate stimulus from any suitable source, and report delivery of a current through a target (e.g. response). For example, when deployment of an electronic control device (e.g., tethered wire electrodes, electrified projectile) has been initiated, the duration of the stimulus, and the magnitude, repetition of stages, load impedance, and other characteristics of the stimulus may be controlled by launch subsystem 310 in cooperation with control process 1626. Process 1626 may coordinate further deployments with reference to target information (e.g., how many targets), policies (e.g., priority given to reducing risk of injury to targets), tactics (e.g., deploy from nearby personal electronic device such as another electronic control device of a security officer), available capabilities (from process 1614), and information about the responses a target has to prior deployments. Responses determined by control deployments process 1626 may be stored in data store 1612. A description of each deployment may be stored in data store 1612 independently or in association with one or more targets (e.g. an electrified restraining net or flash-bang warning delivered to affect a group of targets).

Snoop process 1630 provides analysis of signals received from deployed sensors, bugs, and electrified projectiles (e.g., biometrics). Snoop process output to describe targets process 1606 enables updating target description information in store 1612.

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A method for area denial, performed by an apparatus that inhibits locomotion in or through an area by a human or animal target using a current between a plurality of electrodes, the method comprising:

deploying a plurality of electrodes;

applying a voltage across the electrodes to pass the current through the target;

acquiring surveillance data that describes the target; and determining, in accordance with the surveillance data, a status of the target.

2. The method of claim 1 wherein determining comprises determining whether deploying resulted in inhibiting of locomotion of the target.

3. The method of claim 1 further comprising, in response to determining, repeating the step of deploying.

4. The method of claim 3 wherein repeating is further in accordance with stored tactics and criteria for successful immobilization.

5. The method of claim 1 further comprising, in response to determining, repeating the step of applying.

6. The method of claim 5 wherein repeating is further in accordance with stored tactics and criteria for successful immobilization.

7. The method of claim 1 wherein:

the surveillance data comprises an image; and determining comprises analyzing the image.

8. The method of claim 1 wherein the status of the target corresponds to at least one of moving, stopped, and fallen.

9. The method of claim 1 wherein the status of the target corresponds to at least one of exiting denial zone, and not exiting denial zone.

10. The method of claim 1 wherein determining comprises monitoring changes in a travel vector of the target.

11. The method of claim 1 further comprising in response to determining and in accordance with stored tactics and criteria for successful immobilization, issuing an audible message to the target to encourage the target to move toward a position associated with less risk of injury to the target.

12. The method of claim 1 further comprising in response to determining and in accordance with stored tactics and criteria for successful immobilization, issuing an audible message to the target to encourage the target to move toward a position associated with increased likelihood that a repeat deployment will be successful.

* * * * *